US010273605B2

(12) United States Patent
Kuo et al.

(10) Patent No.: US 10,273,605 B2
(45) Date of Patent: Apr. 30, 2019

(54) METHOD FOR INTEGRALLY WEAVING SHOE EMBRYO HAVING EXTENSION BY FLAT KNITTING MACHINE

(71) Applicant: Wholeknit International Co., Ltd., Apia (WS)

(72) Inventors: Ming-Sheng Kuo, Apia (WS); Yu-Lin Li, Apia (WS); Chien-Hui Yang, Apia (WS)

(73) Assignee: WHOLEKNIT INTERNATIONAL CO., LTD., Apia (WS)

( * ) Notice: Subject to any disclaimer, the term of this patent is extended or adjusted under 35 U.S.C. 154(b) by 100 days.

(21) Appl. No.: 15/497,873

(22) Filed: Apr. 26, 2017

(65) Prior Publication Data

US 2018/0255863 A1 Sep. 13, 2018

(30) Foreign Application Priority Data

Mar. 10, 2017 (TW) ..... 106107956 A

(51) Int. Cl.

*D04B 1/24* (2006.01)
*A43B 1/04* (2006.01)
*D04B 1/22* (2006.01)

(52) U.S. Cl.

CPC ..... *D04B 1/24* (2013.01); *A43B 1/04* (2013.01); *D04B 1/22* (2013.01); *D10B 2403/023* (2013.01); *D10B 2501/043* (2013.01)

(58) Field of Classification Search

CPC ..... D04B 1/24; D04B 1/108; A43B 1/04
See application file for complete search history.

(56) References Cited

U.S. PATENT DOCUMENTS 2,047,724 A * 7/1936 Zuckerman ..... D04B 1/24 36/11
2,147,197 A * 2/1939 Glidden ..... A43B 1/02 36/3 A
2,400,692 A * 5/1946 Herbert ..... A43B 1/04 36/10
5,474,839 A * 12/1995 Ogawa ..... B05D 1/185 428/391
6,931,762 B1 * 8/2005 Dua ..... A43B 1/04 12/142 G
7,347,011 B2 * 3/2008 Dua ..... A43B 1/04 36/45

(Continued)

FOREIGN PATENT DOCUMENTS

EP 2 805 638 A1 11/2014

*Primary Examiner* — Danny Worrell
(74) *Attorney, Agent, or Firm* — Muncy, Geissler, Olds & Lowe, P.C.

(57) ABSTRACT

A method for integrally weaving a shoe embryo having an extension is provided. The extension may be a vamp decoration piece, a shoe lace installation piece, an ankle strap or a toe decoration piece. During a weaving process of the shoe embryo of the method, the extension may be formed simultaneously by knitting at least one of yarns. Thus, by weaving the shoe embryo using the method of the present invention, the extension may be prevented from an additional post-process that may reduce the overall aesthetic features of the woven shoe embryo. Further, because the extension is a formed integral, a process of installing the extension after the shoe embryo is woven as in the prior art is eliminated.

26 Claims, 34 Drawing Sheets

(56) References Cited

U.S. PATENT DOCUMENTS 7,738,991 B2 * 6/2010 Klumpp ..... D04B 1/26 66/185
8,448,474 B1 * 5/2013 Tatler ..... A43B 23/0245 66/64
8,572,866 B2 11/2013 Dojan et al.
8,745,895 B2 * 6/2014 Sokolowski ..... A43B 3/0031 36/50.1
8,839,532 B2 * 9/2014 Huffa ..... A43B 1/04 36/45
9,510,637 B2 * 12/2016 Podhajny ..... A43B 1/04
9,551,096 B2 * 1/2017 Nishino ..... D04B 1/26
9,644,292 B2 * 5/2017 Kino ..... D04B 1/24
9,968,156 B2 * 5/2018 Huffman ..... A43B 23/024
9,976,236 B2 * 5/2018 Terai ..... D04B 1/24
2014/0150292 A1 * 6/2014 Podhajny ..... A43B 23/0205 36/50.1
2014/0245633 A1 * 9/2014 Podhajny ..... A43B 1/04 36/45
2014/0245634 A1 * 9/2014 Podhajny ..... A43B 23/0245 36/54
2015/0107307 A1 * 4/2015 Kosui ..... D04B 1/22 66/177
2015/0223561 A1 8/2015 Kilgore et al.
2015/0250256 A1 9/2015 Podhajny
2016/0058099 A1 3/2016 Panian et al.
2016/0089578 A1 3/2016 Liu et al.
2016/0128428 A1 * 5/2016 Ikenaka ..... A43B 23/08 36/45
2016/0143394 A1 * 5/2016 Ikenaka ..... A43B 1/04 36/45
2016/0198797 A1 * 7/2016 Ikenaka ..... A43B 1/04 36/45
2016/0208421 A1 7/2016 Baines et al.
2016/0219966 A1 8/2016 Podhajny et al.
2017/0000216 A1 1/2017 Dua et al.
2017/0049187 A1 * 2/2017 Aristizabal ..... D04B 1/24

* cited by examiner

METHOD FOR INTEGRALLY WEAVING SHOE EMBRYO HAVING EXTENSION BY FLAT KNITTING MACHINE

FIELD OF THE INVENTION

The present invention relates to a method for integrally weaving a shoe embryo by a flat knitting machine, and particularly to a method that weaves an extension during the process of weaving the shoe embryo.

BACKGROUND OF THE INVENTION

In a conventional shoe manufacturing method, a shoe is usually spliced from multiple shoe pieces, as disclosed by the U.S. Pat. No. 8,572,866. However, with the evolving changes and trends of the footwear manufacturing industry, knitted/woven shoes have become available, such as Nike™ Free Run Flyknit. Patents associated with knitted footwear may be referred from the U.S. Patent Publication Nos. 2015/0223561, 2015/0250256, 2016/0058099, 2016/0089578, 2016/0219966, 2016/0208421 and 2017/0000216. Further, the European Patent No. 2805638A1 discloses a footwear and knitting method for knit a fabric. Although the footwear is seamlessly woven by a flat knitting machine, the footwear completed using the European Patent No. 2805638A1 is identical to the foregoing patents; that is, a surface of the shoe does not include any decoration pieces nor installation pieces, in a way that the shoe body can present different patterns only through weaving patterns of the surface. If decoration pieces or installation pieces are needed due to design requirements, at least one process on the shoe body is needed to secure the decoration pieces or installation pieces on the shoe body. Thus, not only original aesthetic features of the knitted shoe may be sabotaged but also several additional production processes in the manufacturing of the shoe are resulted.

SUMMARY OF THE INVENTION

It is a primary object of the present invention to solve the issue of the prior art in which an extension cannot be integrally woven.

To achieve the above object, the present invention provides a method for integrally weaving a shoe embryo having an extension by a flat knitting machine. The method includes following steps.

In step S10, an initial shoe edge is interwoven by knitting at least two yarns.

In step S11, a first shoe upper connected to the initial shoe edge is woven by knitting the at least two yarns, weaving is continued in a reverse direction when a shoe upper stitch count is reached to weave a second shoe upper facing the first shoe upper by knitting the at least two yarns, and the first shoe upper in woven in a reverse direction according to the shoe upper stitch count. Thus, the above process is cyclically performed to weave the first shoe upper and the second shoe upper.

In step S12, an extension is woven by knitting at least one of the yarns when the shoe upper stitch count is reached in the previous step, and weaving is continued in a reverse direction when a stitch count of the extension is reached while weaving the extension. When the extension stitch count is again reached, the first shoe upper and the second shoe upper are woven by knitting the at least two yarns according to the shoe upper stitch count. Thus, the above process is cyclically performed to weave the extension, the first shoe upper and the second shoe upper.

In step S13, the first shoe upper and the second shoe upper are woven cyclically by knitting the two yarns, and a shoe opening is formed to complete the shoe embryo.

In one embodiment, the extension may be one of a vamp decoration piece and an ankle strap of the shoe embryo. The extension is connected to a vamp section of the shoe embryo when being the vamp decoration piece, and is connected a heel section having the shoe opening of the shoe embryo when being the ankle strap.

In one embodiment, in step S12, after the extension is woven, when the shoe upper stitch count is reached while weaving the first shoe upper or the second shoe upper by knitting the two yarns, another extension facing the extension is woven by knitting at least one of the yarns, and weaving in a reverse direction is continued when the extension stitch count is reached while weaving the another extension. When the extension stitch count is again reached, the first shoe upper or the second shoe upper is woven by knitting the at least two yarns according to the shoe upper stitch count, and weaving of the extension is continued when the shoe upper stitch count is reached. Thus, the above process is cyclically performed to weave the first shoe upper, the second shoe upper and the two extensions.

In one embodiment, while weaving each of the extensions in step S12, a strap is that partially extends from the extension is formed by knitting at least one of the yarns according to an additional stitch count. The strap is a shoe lace of the shoe embryo.

In one embodiment, the two yarns are in different colors.

In one embodiment, the color of the yarn revealed at the first shoe upper or the second shoe upper is different from the color of the yarn of the extension located at the same side.

In one embodiment, one of the two yarns is clad by a hot melt layer.

In one embodiment, the method further includes step S15 before step S10. In step S15, another extension located at a front end of the shoe embryo is woven by knitting at least one of the yarns, and step S10 is performed after weaving is completed. The extension connected to the initial shoe edge is a toe decoration piece of the shoe embryo.

In one embodiment, the method further includes step S16 after step S13. In step S16, a first lining connected to the first shoe upper is woven by knitting the at least two yarns, weaving is continued in a reverse direction when the shoe upper stitch count is reached to weave a second lining that faces the first lining and is connected to the second shoe upper by knitting the two yarns, and the first shoe lining is woven in a reverse direction according to the shoe upper stitch count. Thus, the above process is cyclically performed to weave the first lining and the second lining.

In one embodiment, the method further includes step S17 after step S16. In step S17, a lining end edge is interwoven by knitting the two yarns, and another extension is woven towards a direction away from the lining end edge by knitting at least one of the yarns. The extension is a sole piece.

The present invention further provides another method. The method includes following steps.

In step S20, an extension is woven by knitting at least one yarn. The extension is a toe decoration piece of a shoe embryo when it is completely woven.

In step S21, an initial shoe edge connected to the extension is interwoven by knitting the two yarns.

In step S22, a first shoe upper connected to the initial shoe edge is woven by knitting the at least two yarns, weaving is continued in a reverse direction when a shoe upper stitch count is reached to weave a second shoe upper facing the first shoe upper by knitting the two yarns, and the first shoe upper is woven in a reverse direction according to the shoe upper stitch count. Thus, the above process is cyclically performed to weave the first shoe upper and the second shoe upper, and a shoe opening is formed to complete the shoe embryo.

In one embodiment, the two yarns are in different colors.

In one embodiment, the color of the yarn revealed at the first shoe upper or the second shoe upper is in a different from the color of the yarn of the extension located at the same side.

In one embodiment, one of the two yarns is clad with a hot melt layer.

In one embodiment, the method further includes step S23 after step S22. In step S23, a first lining connected to the first shoe upper is woven by knitting the at least two yarns, weaving is continued in a reverse direction when the shoe upper stitch count is reached to weave a second lining that faces the first lining and is connected to the second shoe upper by knitting the two yarns, and the first lining is woven in a reverse direction according to the shoe upper stitch count. Thus, the above process is cyclically performed to weave the first lining and the second lining.

In one embodiment, the method further includes step S24 after step S23. In step S24, a lining end edge is interwoven by knitting the two yarns, and another extension is woven towards a direction away from the lining end edge by knitting at least one of the yarns. The extension is a sole piece.

The technical solution disclosed by the present invention provides following features compared to the prior art. In the present invention, the shoe embryo is an integrally woven by a flat knitting machine, the extension is integrally woven when the shoe embryo is woven, and the extension may be the vamp decoration piece, the shoe lace installation piece, the ankle strap or the toe decoration piece. Accordingly, the extension may be formed when the knitted shoe prototype is manufactured from the shoe embryo, hence preventing a post-process from affecting overall aesthetic features of the knitted shoe prototype or from increasing an additional manufacturing process.

DETAILED DESCRIPTION OF THE PREFERRED EMBODIMENTS

Figure 1:
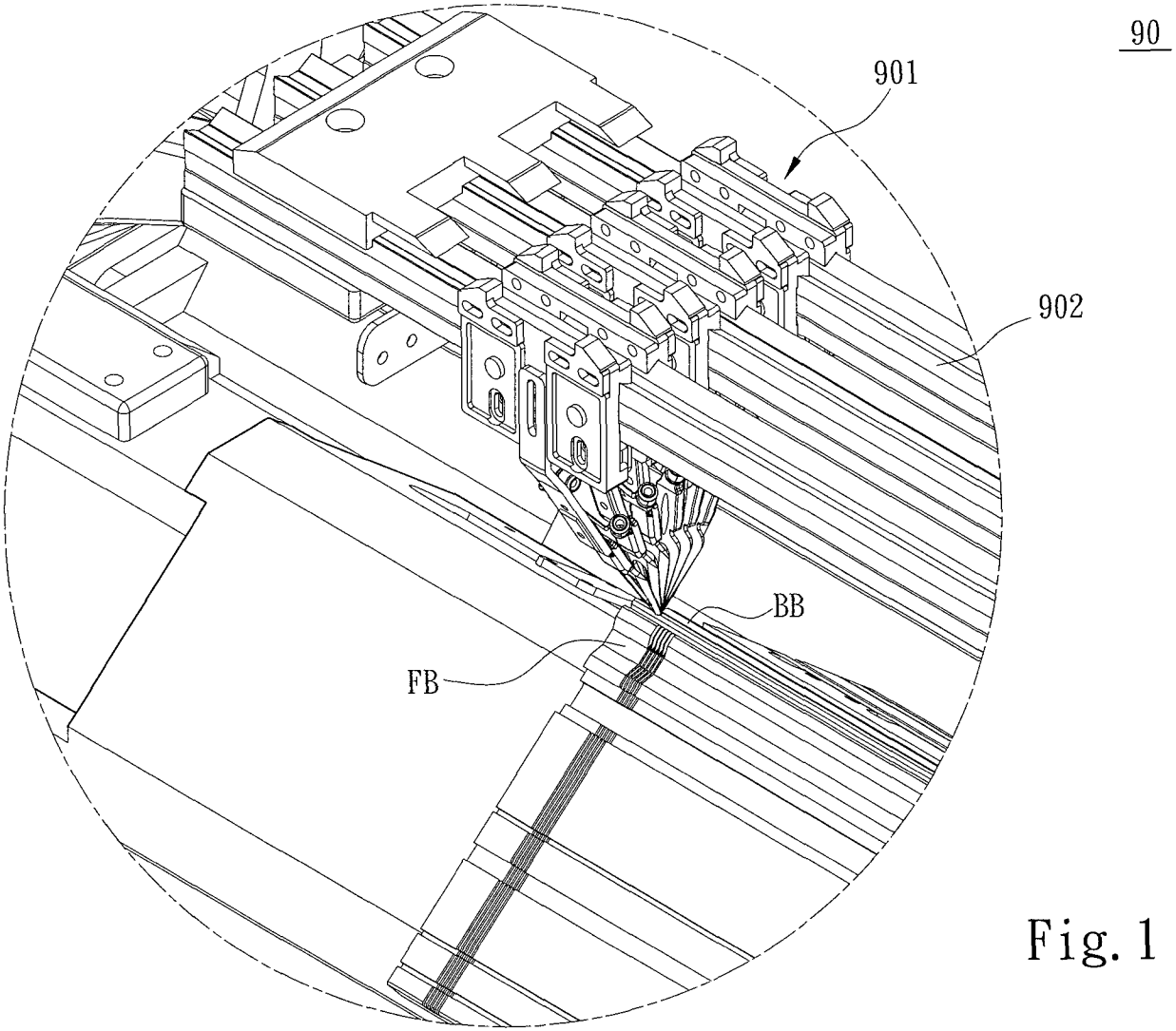
FIG. 1 is a schematic diagram of a partial structure of a flat knitting machine.
Figure 2:
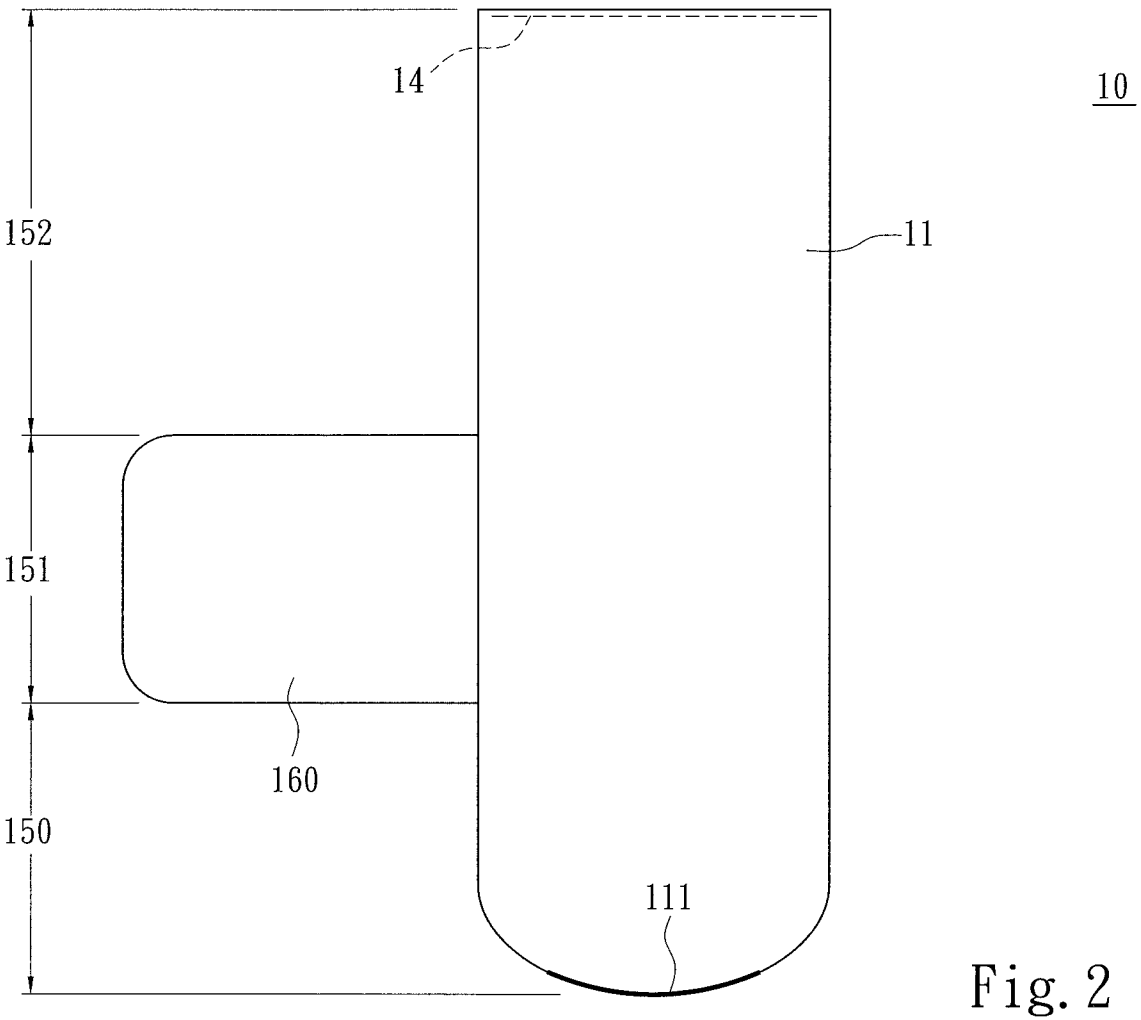
FIG. 2 is a planar schematic diagram of a shoe embryo according to a first embodiment of the present invention.
Figure 3:
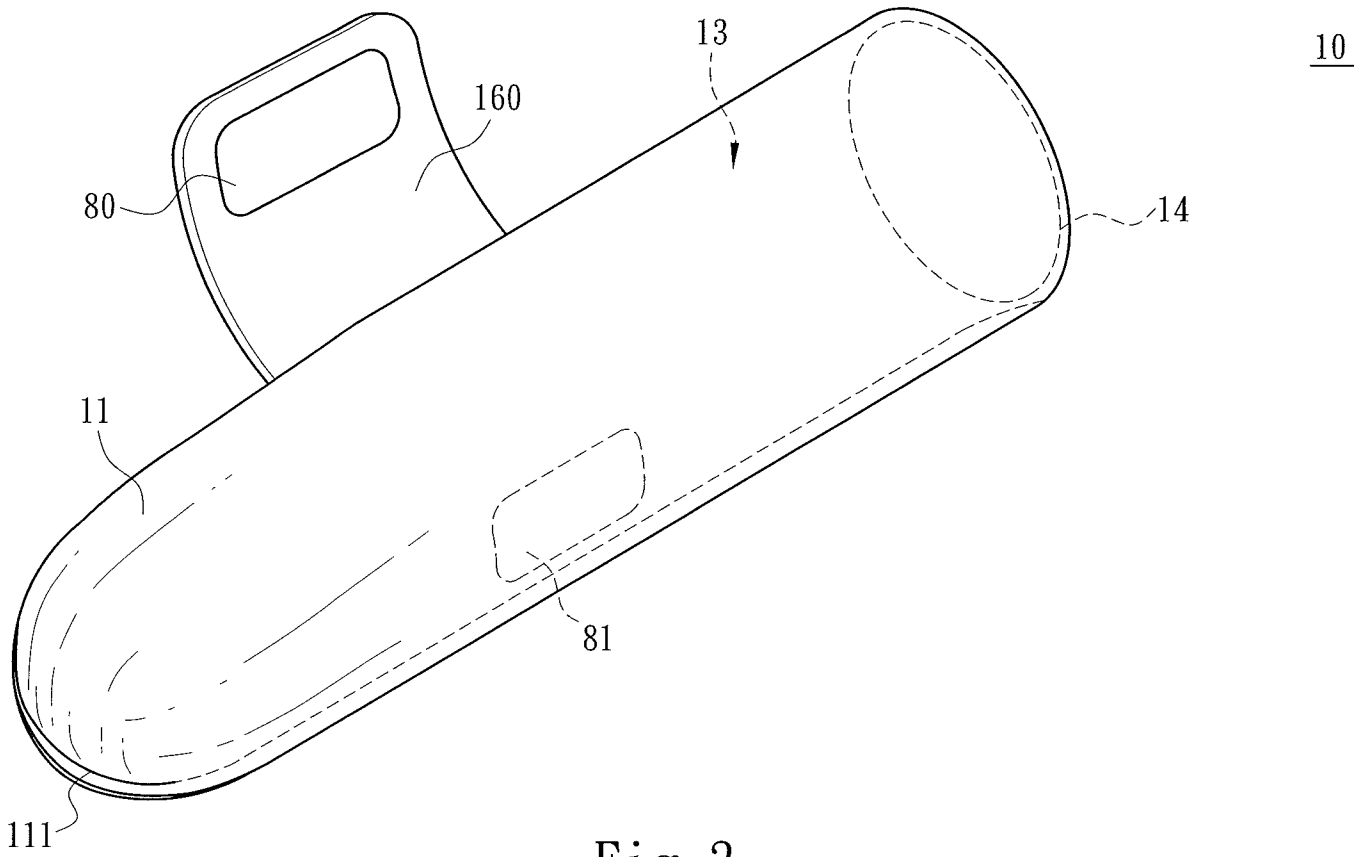
FIG. 3 is a perspective structural schematic diagram of a shoe embryo according to the first embodiment of the present invention.

Referring to FIG. 1, the present invention provides a method for integrally weaving a shoe embryo having an extension by a flat knitting machine. The present invention is realized by a front needle bed FB and a back needle bed BB included in a flat knitting machine 90. Structural details of the front needle bed FB and the back needle bed BB are generally known to one person skilled in the art, and shall be omitted herein. An operating personnel may configure settings of a weaving operation of the front needle bed FB and the back needle bed BB based on the method of the present invention. Further, before describing the implementation of the method, a basic structure of a shoe embryo 10 is first given as follows. Referring to FIG. 2 and FIG. 3, the shoe embryo 10 is a woven integral, and includes a first shoe upper 11, a second shoe upper 12 facing the first shoe upper 11, an in-shoe space 13 defined by the first shoe upper 11 and the second shoe upper 12, and a shoe opening 14 connected to the in-shoe space 13. An initial shoe edge 111 is generated during the weaving process of the shoe embryo 10. In the present invention, the shoe embryo 10 is further divided into a toe section 150, a vamp section 151 and a heel section 152 for illustration purposes.

Referring to FIG. 2 to FIG. 4 and FIG. 8, according to an embodiment, the method includes following steps.

In step S10, the initial shoe edge 111 is interwoven by knitting at least two yarns 20 and 21.

In step S11, the first shoe upper 11 connected to the initial shoe edge 111 is woven by knitting the at least two yarns 20 and 21. When a shoe upper stitch count is reach, unbroken-yarn weaving is performed in a reverse direction to weave the second shoe upper 12 facing the first shoe upper 11 by knitting the two yards 20 and 21, and the first shoe upper 11 is woven in a reverse direction according to the shoe upper stitch count. Thus, the above process is cyclically performed to weave the first shoe upper 11 and the second shoe upper 12.

In step S12, when the shoe upper stitch count is reached in the previous step, an extension 160 is woven by knitting at least one yarn 20. When an extension stitch count is reached while weaving the extension 160, unbroken-yarn weaving is performed in a reverse direction. When the extension stitch count is again reached, the first shoe upper 11 and the second shoe upper 12 are woven by knitting the at least two yarns 20 and 21 according to the shoe upper stitch count. Thus, the above process is cyclically performed to weave the extension 160 (or 161), the first shoe upper 11 and the second shoe upper 12.

In step S13, the first shoe upper 11 and the second shoe upper 12 are cyclically woven by knitting the two yarns 20 and 21, and the shoe opening 14 is formed, thus completing the shoe embryo 10.

More specifically, at the beginning of the implementation, weaving schedules of the front needle bed FB and the back needle bed BB of the flat knitting machine 90 have been configured according to the method. It should be noted that, a yarn feeding mechanism 901 of the flat knitting machine 90 moves along a lateral track 902, progresses from an initial position towards an end position, and performs yarn feeding from the end position towards the initial position, hence causing the front needle bed FB and the back needle bed BB to weave a fabric according to the above cycle. Further, the yarn feeding mechanism 901 is implemented in coordination with a nose (not shown), and knitting operations of the front needle bed FB and the back needle bed BB are controlled by the nose. Further, the two yarns 20 and 21 forming the shoe embryo 10 may be in different colors, which present different colors at inner and outer surfaces of the first shoe upper 11 and the second shoe upper 12. In other words, when the two yarns 20 and 21 are in different colors, a technical front color of a fabric and a technical back color of the fabric are different. Further, one of the two yarns 20 and 21 may be clad by a hot melt layer. Thus, when the shoe embryo 10 is completed, it may be placed into a mold and be appropriately heated to allow the yarn 20 (or 21) clad with the hot melt layer to hot melt, and the shoe embryo 10 may then shape according to an appearance of the mold to complete a knitted shoe prototype 100. Further, the two yarns 20 and 21 of the present invention may be intertwined from twisting. In step S10, the flat knitting machine 90 causes the front needle bed FB and the back needle bed BB to knit simultaneously, such that the initial shoe edge 111 is formed by interweaving the two yarns 20 and 21, and step S11 is then performed in a unbroken-yarn manner after the initial shoe edge 111 is woven.

Figure 4:
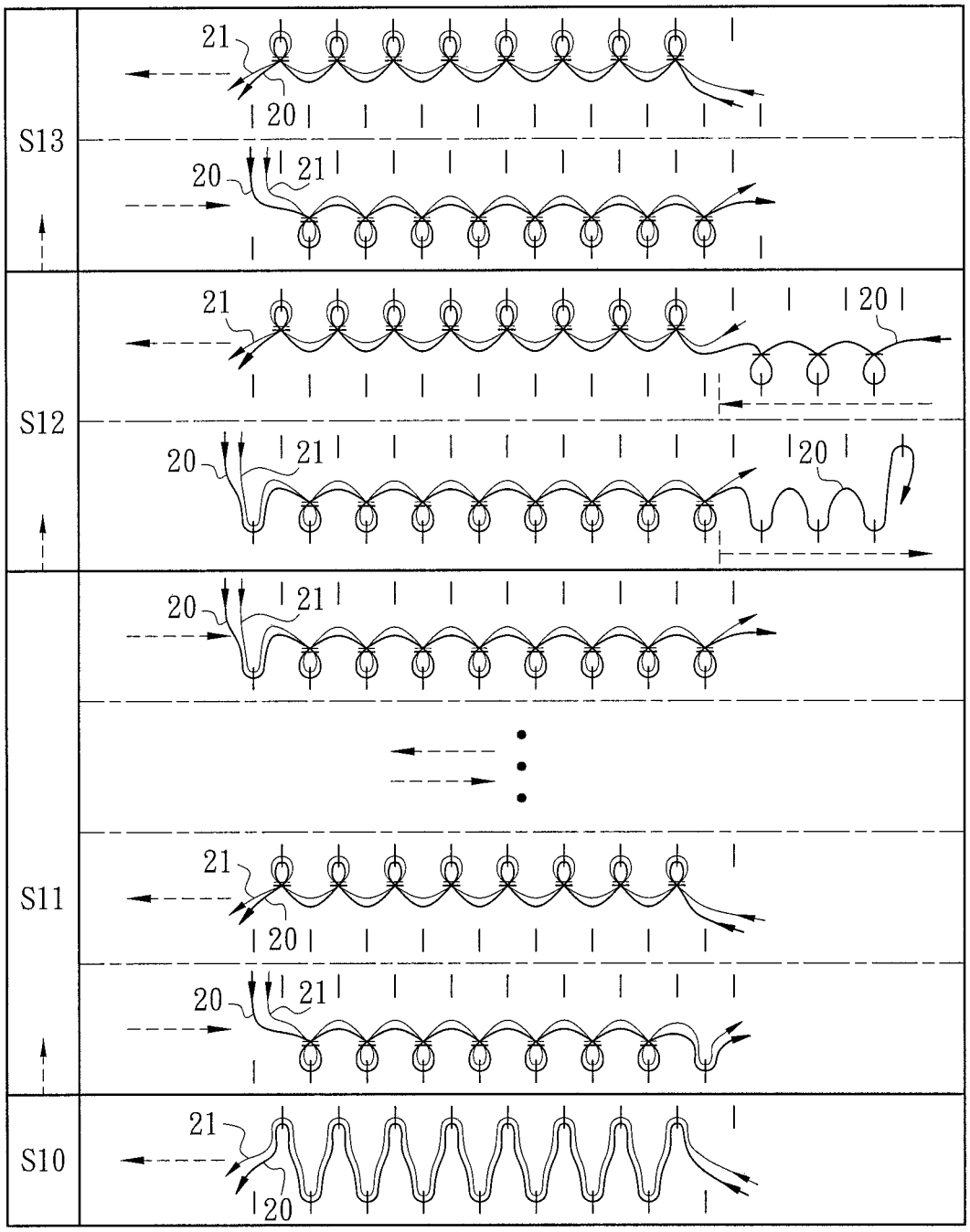
FIG. 4 is a schematic diagram of a weaving process according to the first embodiment of the present invention.

Referring to FIG. 4, during step S11, the front needle bed FB weaves the first shoe upper 11 in an extended manner from one end of one side of the initial shoe edge 111. When the front needle bed FB reaches the shoe upper stitch count while weaving the first shoe upper 11, the flat knitting machine 90 continues yarn feeding in a reverse direction in an unbroken-yarn manner, such that the back needle bed BB continues knitting the two yarns 20 and 21 to weave the second shoe upper 12. After that, each time the front needle bed FB or the back needle bed BB reaches the shoe upper stitch count, the yarn feeding mechanism 901 is reversed, hence cyclically weaving the first shoe upper 11 and the second shoe upper 12. However, the shoe upper stitch count of the present invention may be a variable value instead of being limited to a constant value, and the variable value may be correspondingly set according to a shoe model to be later completed. For example, the shoe upper stitch count of the toe section 150 is greater than the shoe upper stitch count of the vamp section 151. Further, the weaving schedule of step S11 is correspondingly designed according to the size of the shoe embryo 10.

Figure 5:
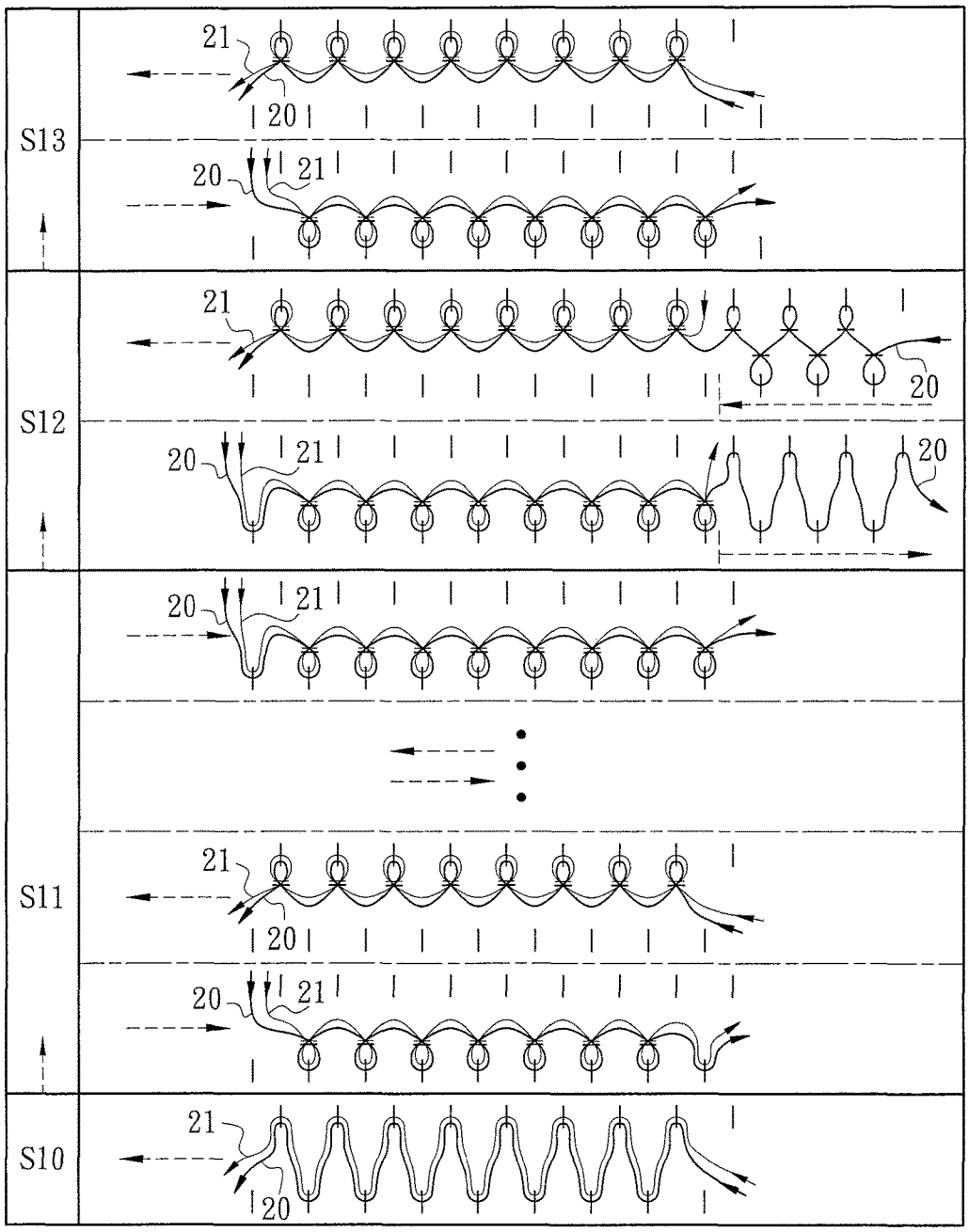
FIG. 5 is a schematic diagram of a weaving process according to a second embodiment of the present invention.
Figure 6:
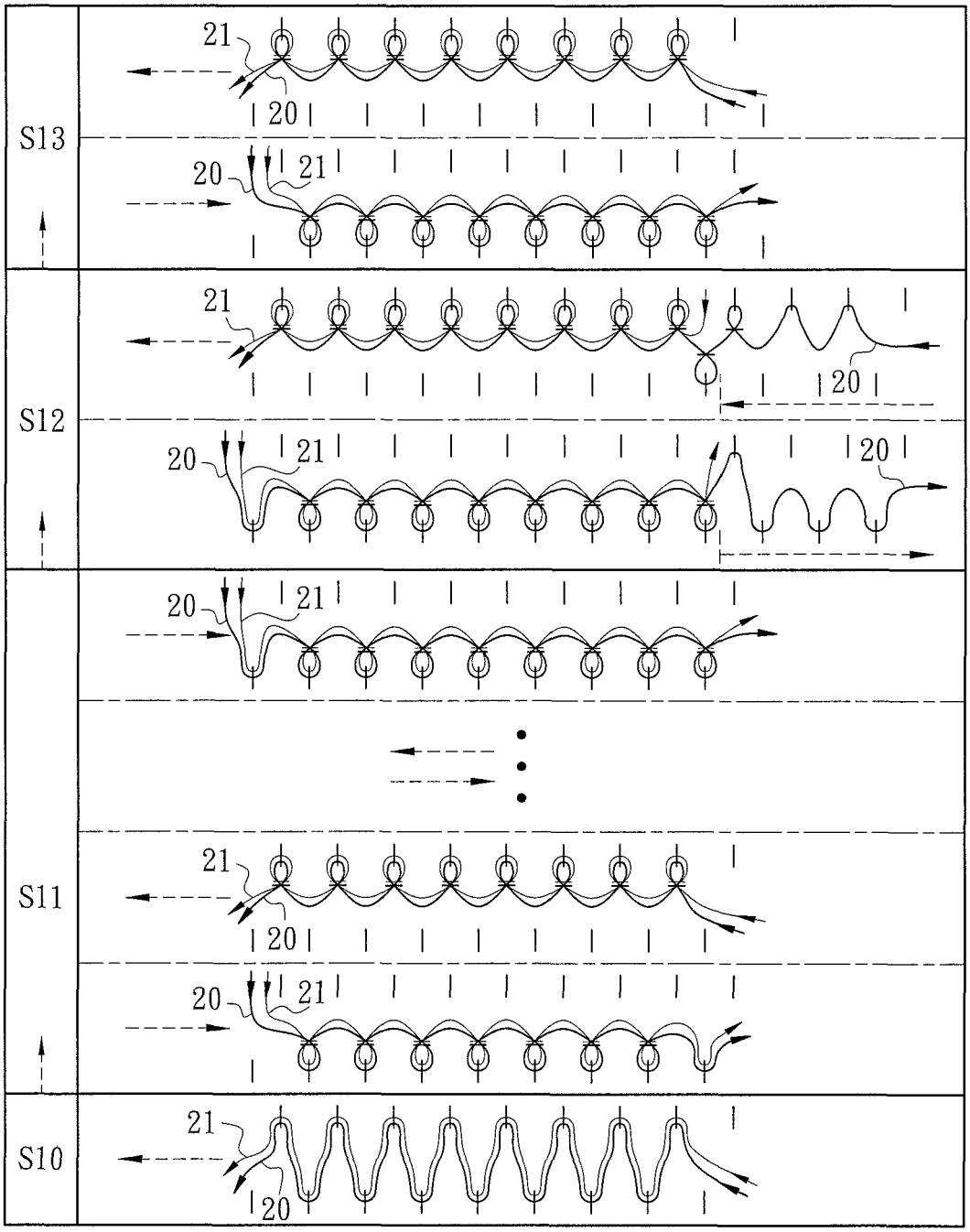
FIG. 6. is a schematic diagram of a weaving process according to the third embodiment of the present invention.

A trigger point for entering step S12 from step S11 of the present invention is based on the design of the shoe embryo 10. For example, when the back needle bed BB reaches the shoe upper stitch count while weaving the second shoe upper 12, and the first shoe upper 11 and the second shoe upper 12 have reached predetermined lengths, the yarn feeding mechanism 901 is controlled to progress in a non-reversed direction and to weave the extension 160 along the current weaving direction by knitting the at least one of the yarns 20 and 21. During the process of weaving the extension 160, the flat knitting machine 90 controls the nose to weave in a non-reversed manner and the front needle bed FB to weave the extension 160, such that the extension 160 protrudes from edges of the first shoe upper 11 and the second shoe upper 12 when the extension 160 is completely woven to appear as a wing, as shown in FIG. 3. Further, during the weaving process of the extension 160, when the front needle bed FB reaches the extension stitch count while knitting the extension 160, the flat knitting machine 90 continues weaving the extension 160 in a reverse direction. When the front needle bed FB again reaches the extension stitch count, the flat knitting machine 90 controls the front needle bed FB and the back needle bed BB to continuously weave the first shoe upper 11 and the second shoe upper 12 by knitting the two yarns 20 and 21. Details of the weaving process of the first shoe upper 11 and the second shoe upper 12 are as described in step S11, and shall be omitted. Further, the extension stitch count of the present invention may be adjusted according to the pattern of the extension 160; that is, the extension stitch count may be a variable value. Further, instead of being implemented by single-sided weaving in FIG. 4, the extension 160 of the present invention may also be performed by dual-sided weaving, or in continuation of a sac-like weaving approach of the first shoe upper 11 and the second shoe upper 12. Referring to FIG. 5 showing dual-sided weaving, during a dual-sided weaving process, the flat knitting machine 90 simultaneously controls the front needle bed FB and the back needle bed BB to weave the extension 160. Further, referring to FIG. 6 showing sac-like weaving, the flat knitting machine 90 utilizes the front needle bed FB to perform an initial weaving process of the extension 160, and then utilizes the back needle bed BB to continue weaving the extension 160 in a reverse direction when the front needle bed FB reaches the extension stitch count. Thus, the extension 160 appears as a sac, and forms a space (not shown) that is in communication with the in-shoe space 13.

Figure 7:
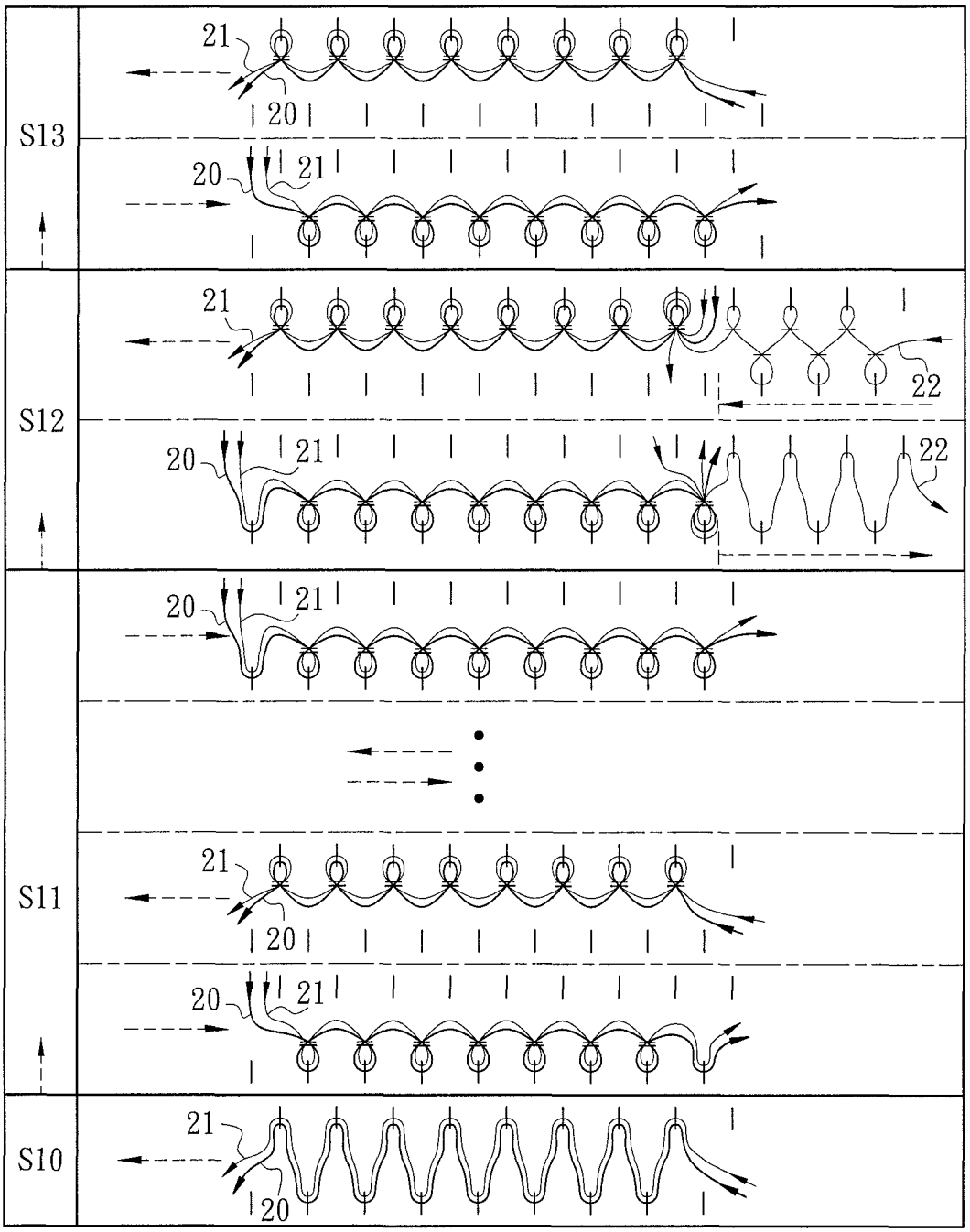
FIG. 7 is a schematic diagram of a weaving process according to the fourth embodiment of the present invention.

Referring to FIG. 7, in addition to weaving the extension 160 of the present invention by the yarn 20 (or 21) that forms the first shoe upper 11 or the second shoe upper 12, while weaving the extension 160 in step S12, the flat knitting machine 90 may be caused to suspend feeding the yarn 20 (or 21), and to feed a new yarn 22 to weave the extension 160. Implementation details of adjusting such yarn feeding are generally known to one person skilled in the art, and shall be omitted herein. Thus, the color of the extension 160 may be made different from that of the body of the shoe embryo 10 to provide the shoe embryo 10 with overall color variations.

Figure 8:
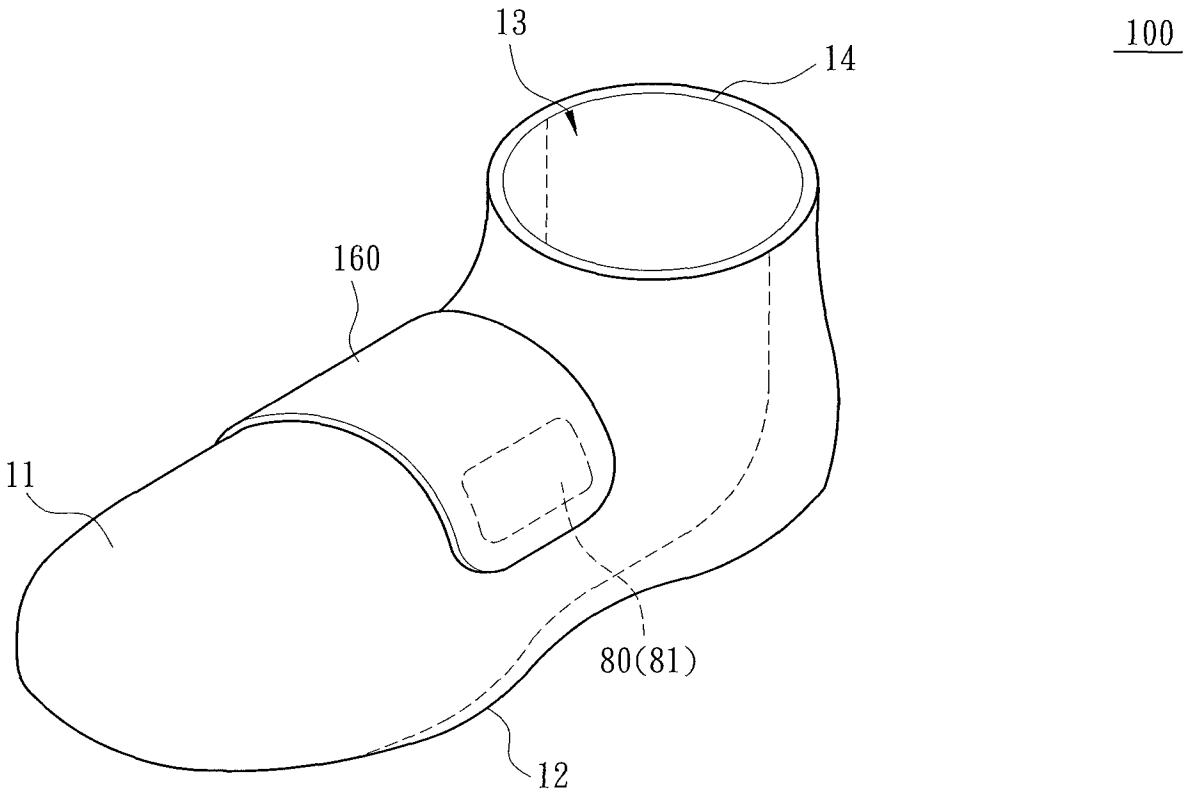
FIG. 8 is a perspective structural schematic diagram of a knitted shoe prototype according to the first embodiment of the present invention.

Step S13 follows step S12. The weaving process in step S13 is similar to that in step S11. In step S13, the front needle bed FB and the back needle bed BB continue from a weaving ending point of step S12 to continuing the weaving of the first shoe upper 11 and the second shoe upper 12, and then shape the shoe opening 14 to complete the shoe embryo 10. However, the weaving approach may be altered at the end of the weaving process in step S13 to provide the shoe embryo 10 with a contracted opening (not shown). Accordingly, by performing an appropriate processing on the woven shoe embryo 10, e.g., a heating process or a paint spray process, a knitted shoe prototype 100 (as shown in FIG. 8) may be completed. A knitted shoe may then be manufactured by additionally adhering a shoe sole (not shown) to a lower surface of the knitted shoe prototype 100.

Figure 9:
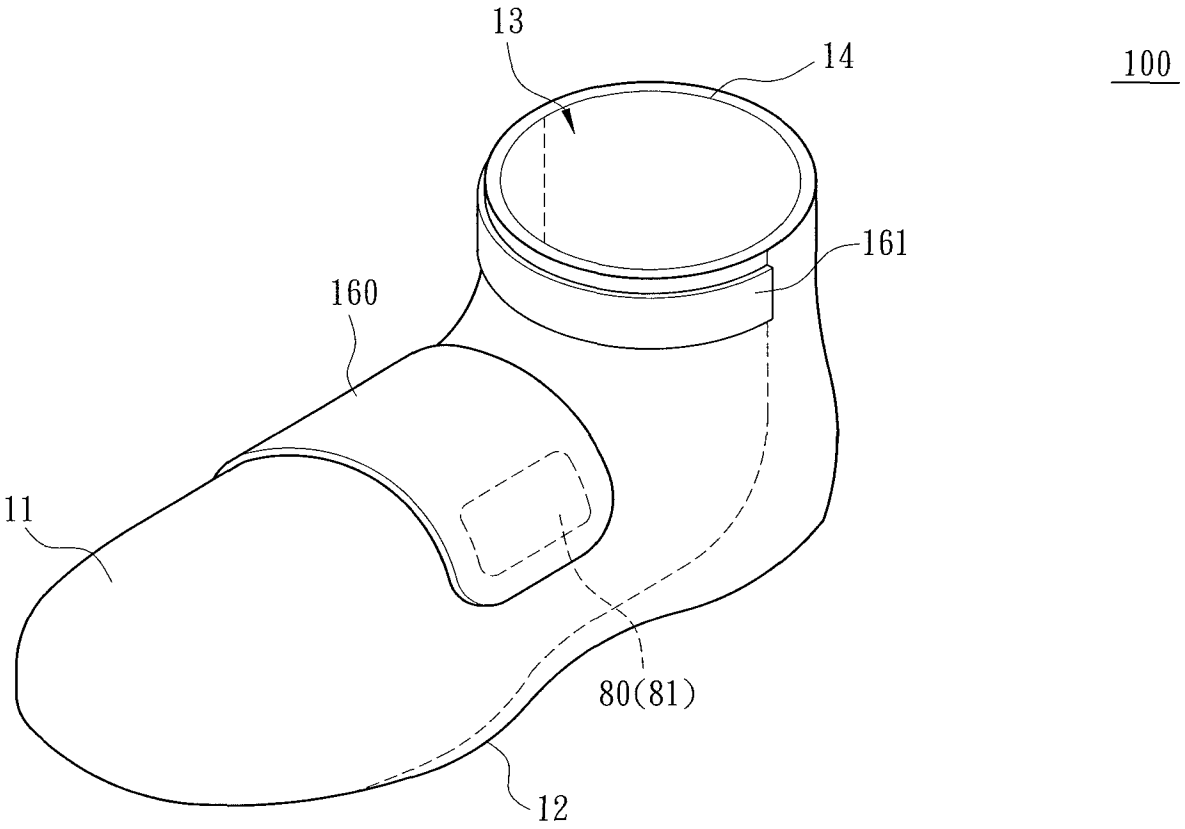
FIG. 9 is a perspective structural schematic diagram of a knitted shoe prototype according to a fifth embodiment of the present invention.

The extension 160 may be located at the vamp section 151 or the heel section 152. When the extension 160 is located at the vamp section 151, the extension 160 serves as a vamp decoration piece, as shown in FIG. 8 and FIG. 9. When the extension 161 is located at the heel section 152, the extension 161 serves as an ankle strap, as shown in FIG. 9. When the woven shoe embryo 10 includes only one single extension 160 (or 161), an end of the extension 160 (or 161) may be further provided with a hook-and-loop fastener (80, 81), a touch fastener (not shown), a selectively removable adhesive element, or a metal fastener, and the shoe embryo 10 is provided with a corresponding structure at a position that can come into contact with the extension 160. Thus, the end that is originally free may become secured on the shoe embryo 10, as shown in FIG. 8. Further, when the extension 161 serving as the ankle strap is implemented by one single piece, the extension 161 may be secured onto the shoe embryo 10 through the above solution, as shown in FIG. 9.

Figure 10:
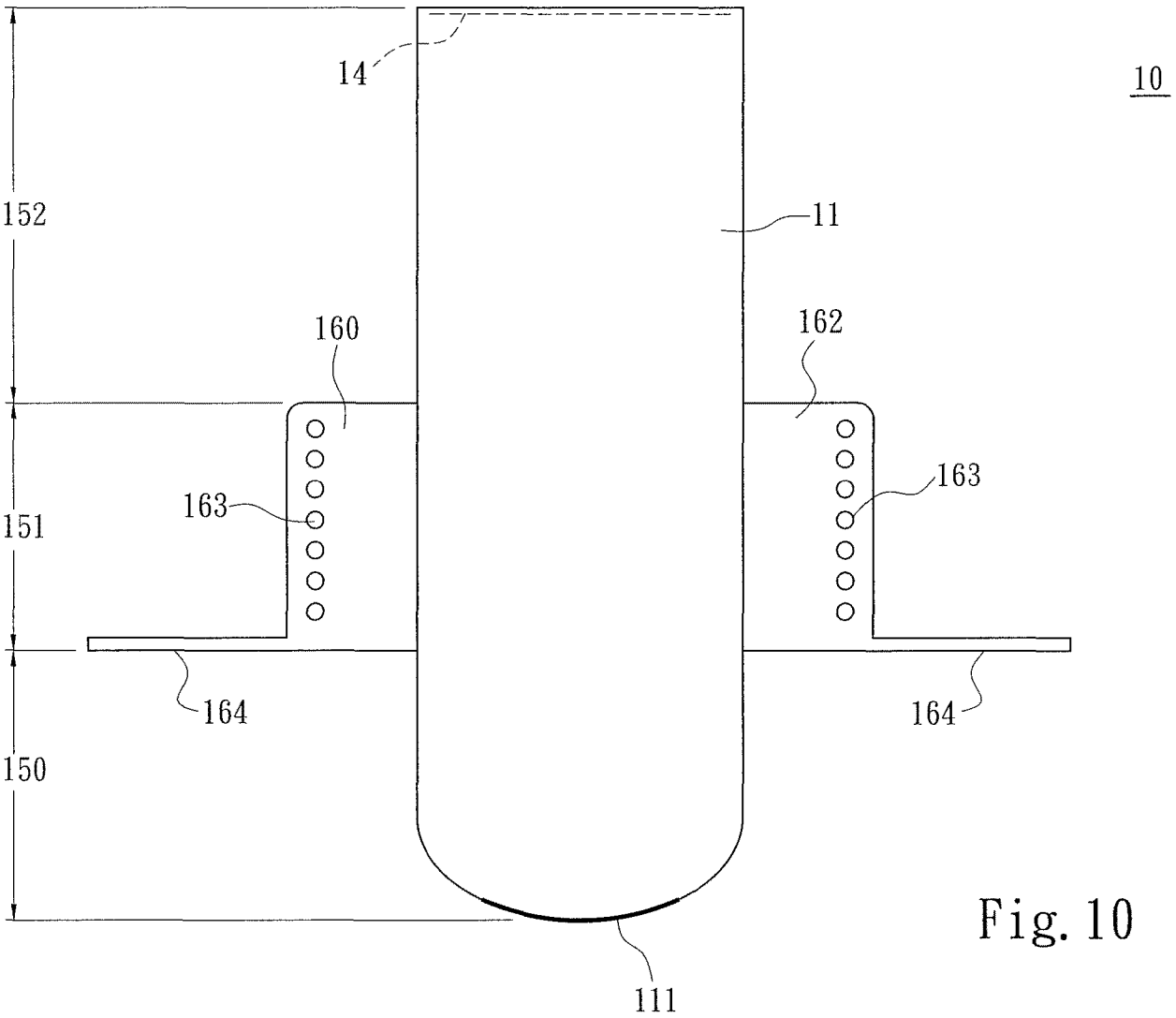
FIG. 10 is a planar schematic diagram of a shoe embryo according to a sixth embodiment of the present invention.
Figure 11:
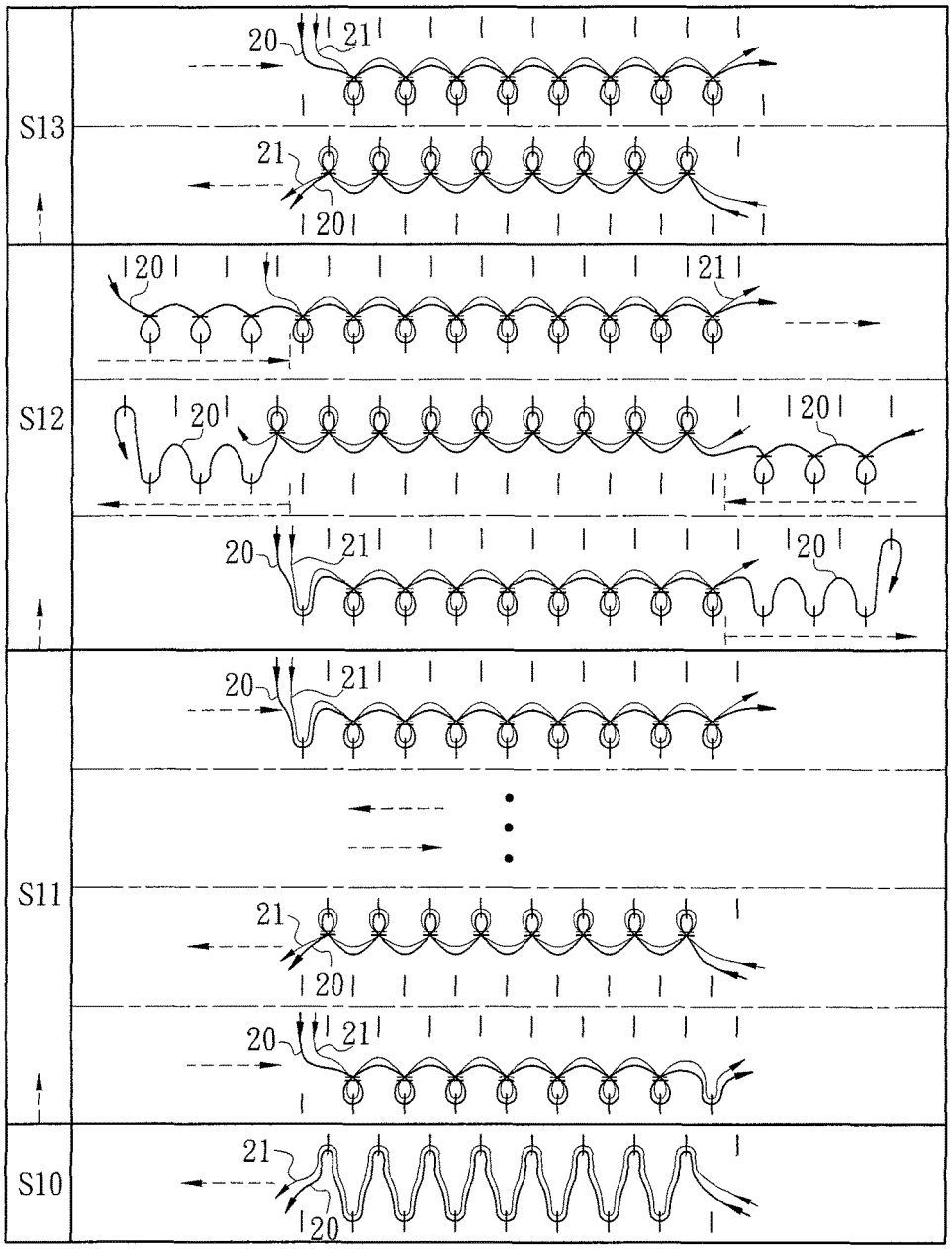
FIG. 11 is a schematic diagram of a weaving process according to the sixth embodiment of the present invention.

Referring to FIG. 10, apart from being implemented by a single piece, the extension 160 may also be implemented by two pieces. As shown in FIG. 11, step S12 further comprises steps below. After the extension 160 is woven, when the extension stitch count is reached while weaving the first shoe upper 11 or the second shoe upper 12 by knitting the at least two yarns 20 and 21, another extension 162 opposite the extension 160 is woven by knitting at least one of the yarns 20 and 21. When the weaving process of the extension 162 reaches the extension stitch count, unbroken-yarn weaving is continued in a reverse direction. When the extension stitch count is again reached, the first shoe upper 11 or the second shoe upper 12 is woven by knitting the at least two yarns 20 and 21 according to the shoe upper stitch count, and the extension 160 is continuously woven when the shoe upper stitch count is reached. Thus, the above process is cyclically performed to weave the first shoe upper 11, the second shoe upper 12 and the two extensions 160 and 162.

Figure 12:
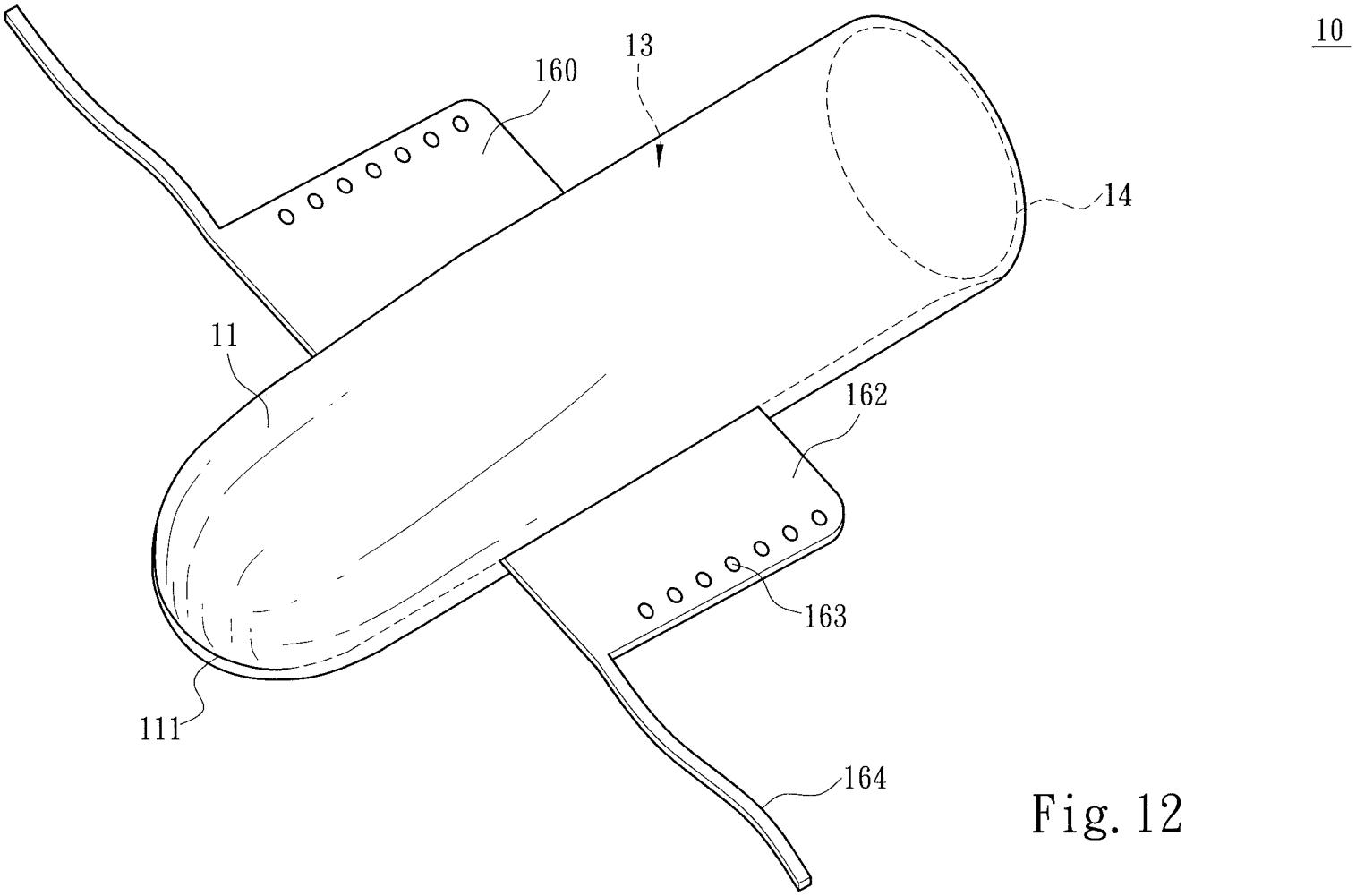
FIG. 12 is a perspective structural schematic diagram of a shoe embryo according to the sixth embodiment of the present invention.
Figure 13:
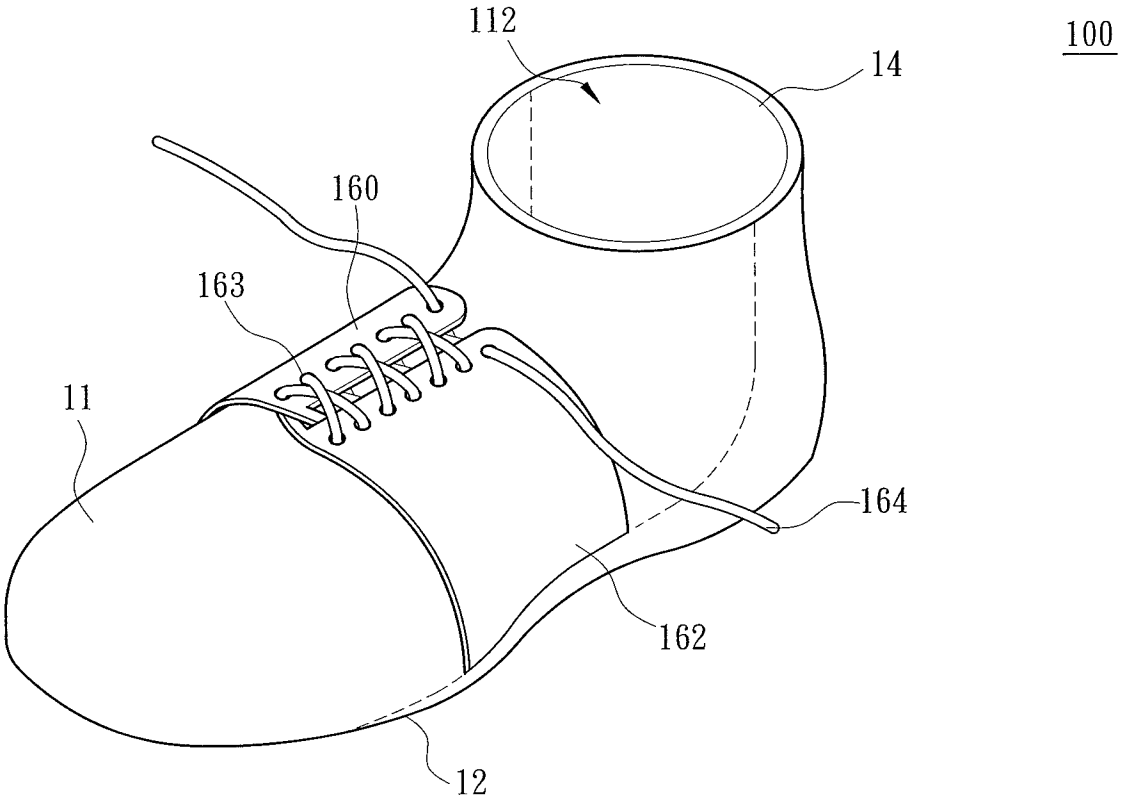
FIG. 13 is a perspective structural schematic diagram of a knitted shoe prototype according to the sixth embodiment of the present invention.
Figure 14:
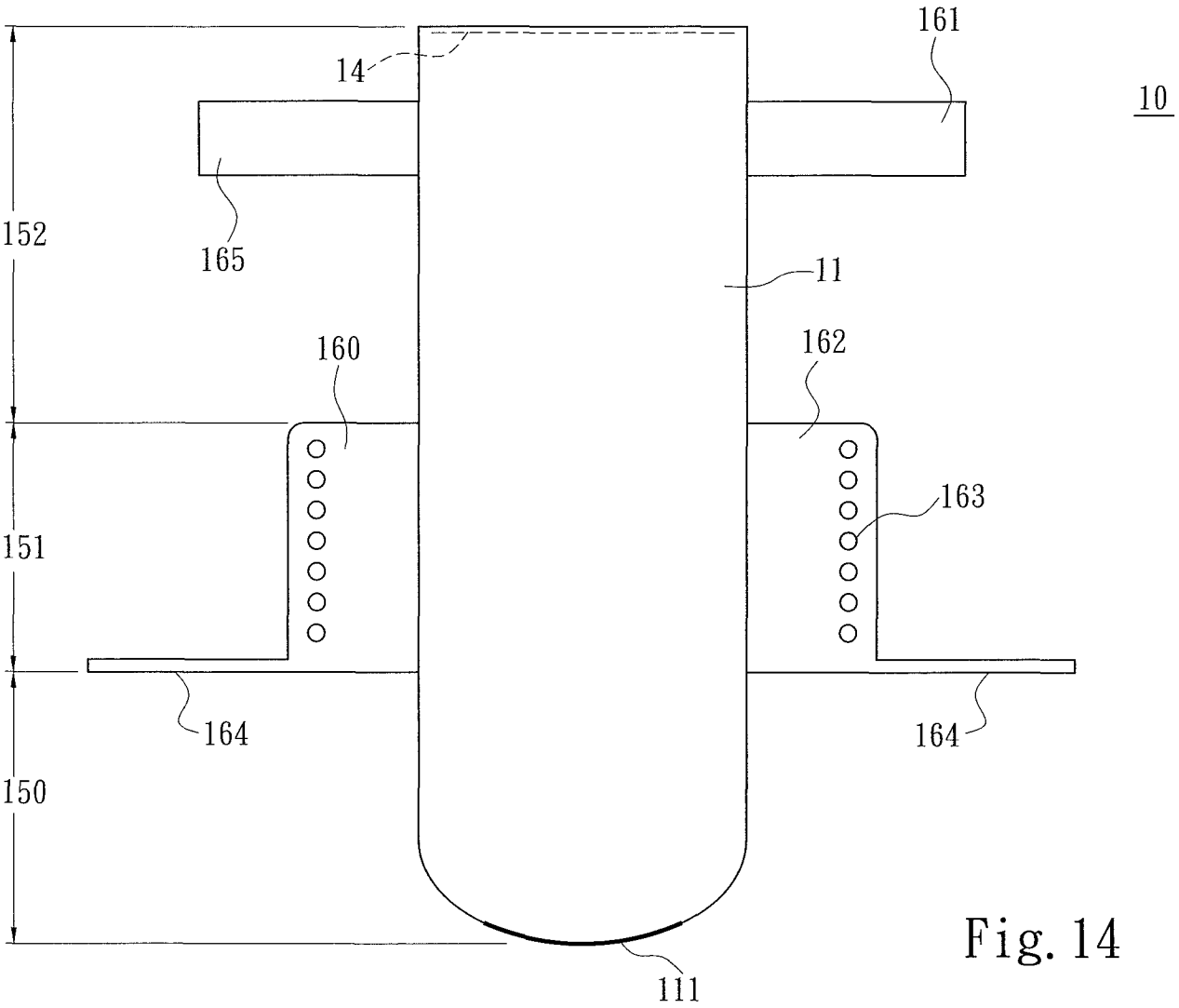
FIG. 14 is a planar schematic diagram of a shoe embryo according to a seventh embodiment of the present invention.
Figure 15:
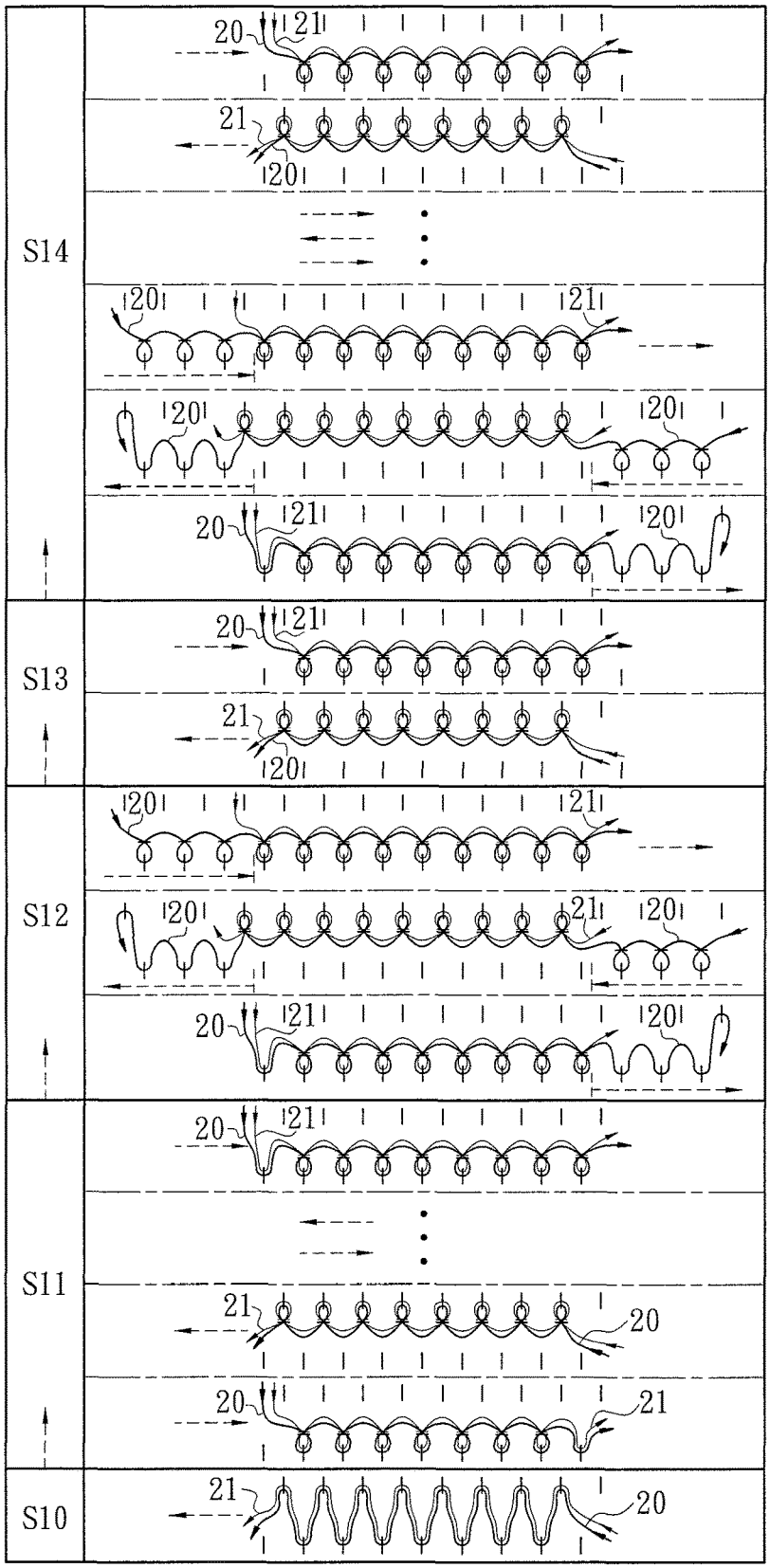
FIG. 15 is a schematic diagram of a weaving process according to the seventh embodiment of the present invention.
Figure 16:
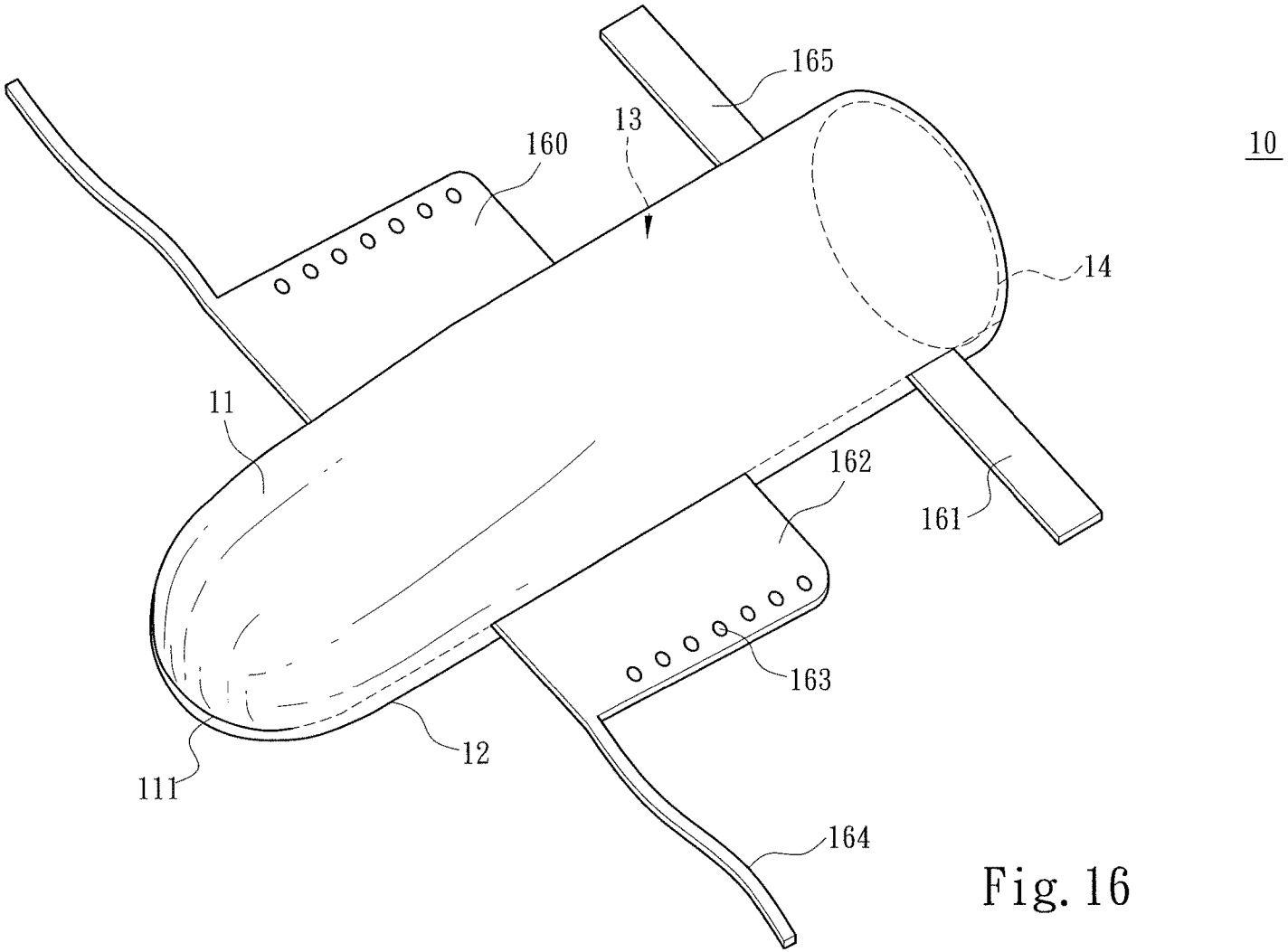
FIG. 16 is a perspective structural schematic diagram of a shoe embryo according to the seventh embodiment of the present invention.
Figure 17:
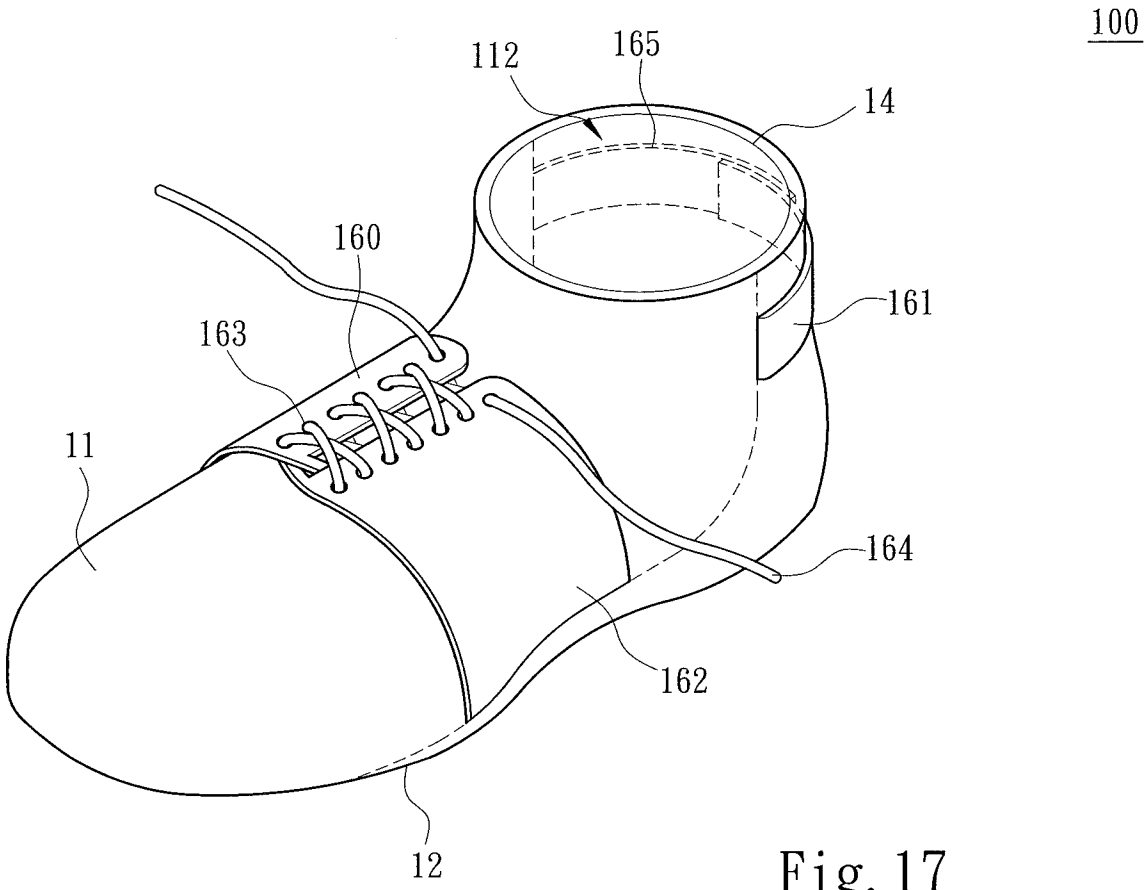
FIG. 17 is a perspective structural schematic diagram of a knitted shoe prototype according to the seventh embodiment of the present invention.
Figure 18:
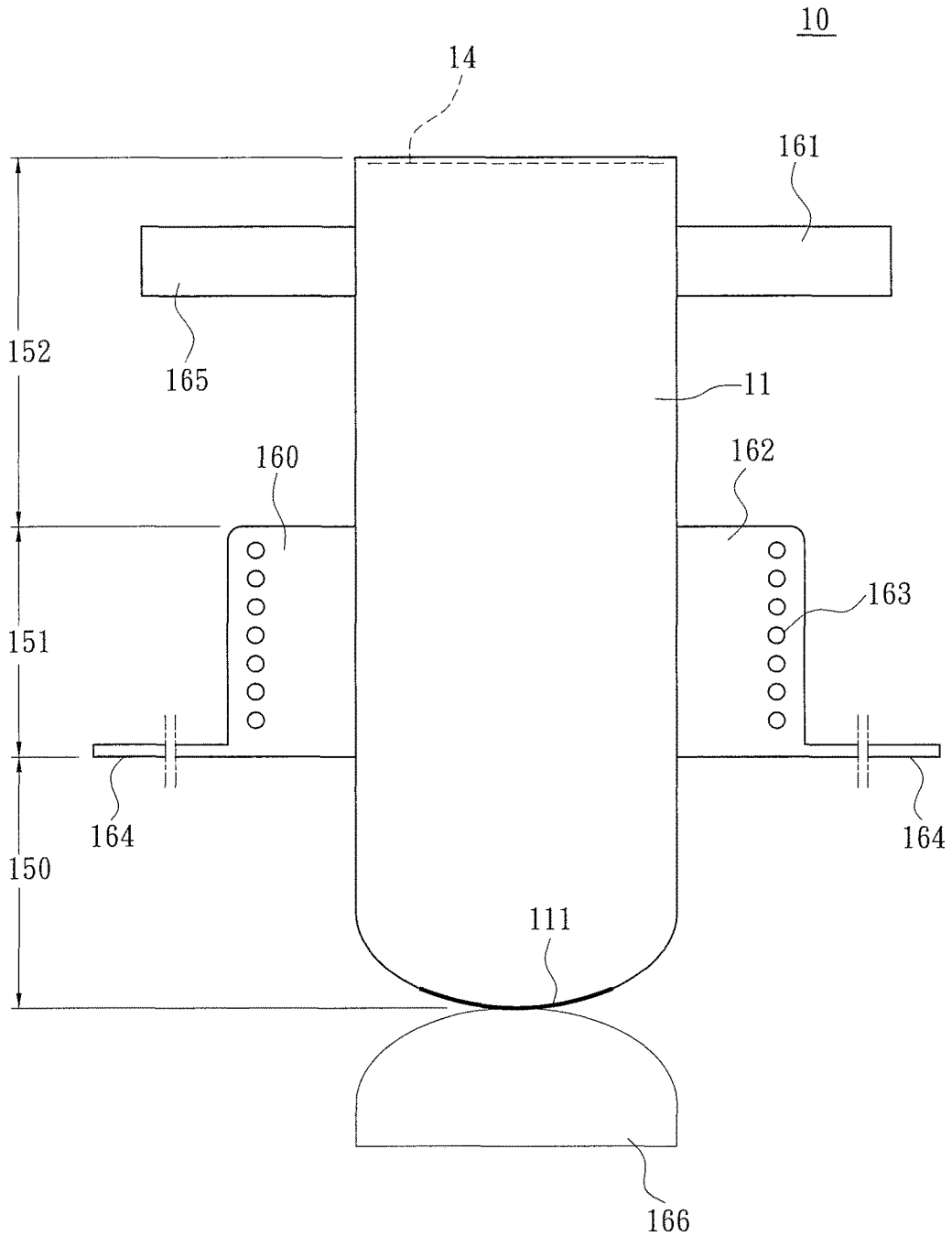
FIG. 18 is a planar schematic diagram of a shoe embryo according to an eighth embodiment of the present invention.
Figure 19A:
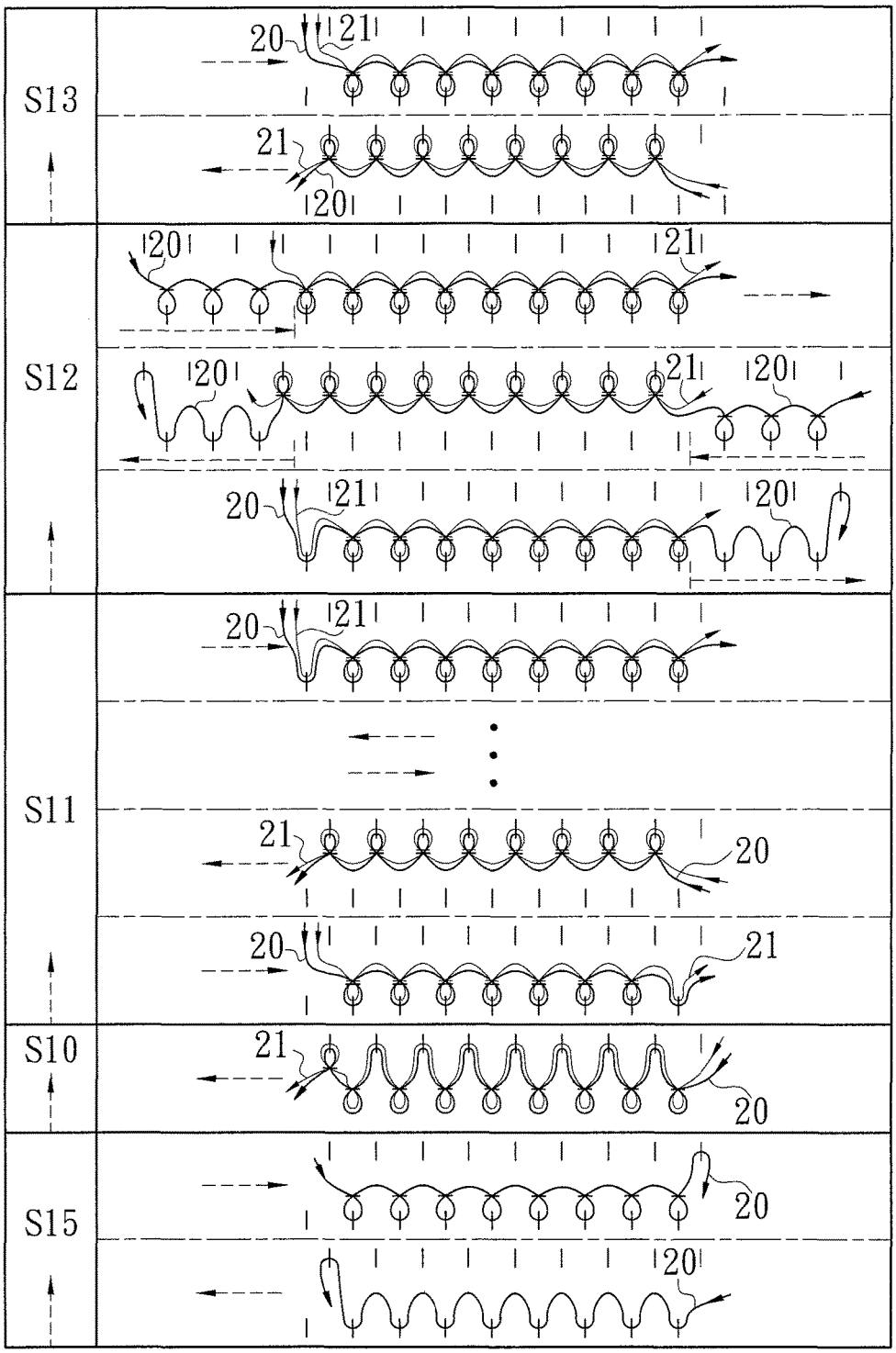
FIG. 19A is a first continuous schematic diagram of a weaving process according to the eighth embodiment of the present invention.
Figure 19B:
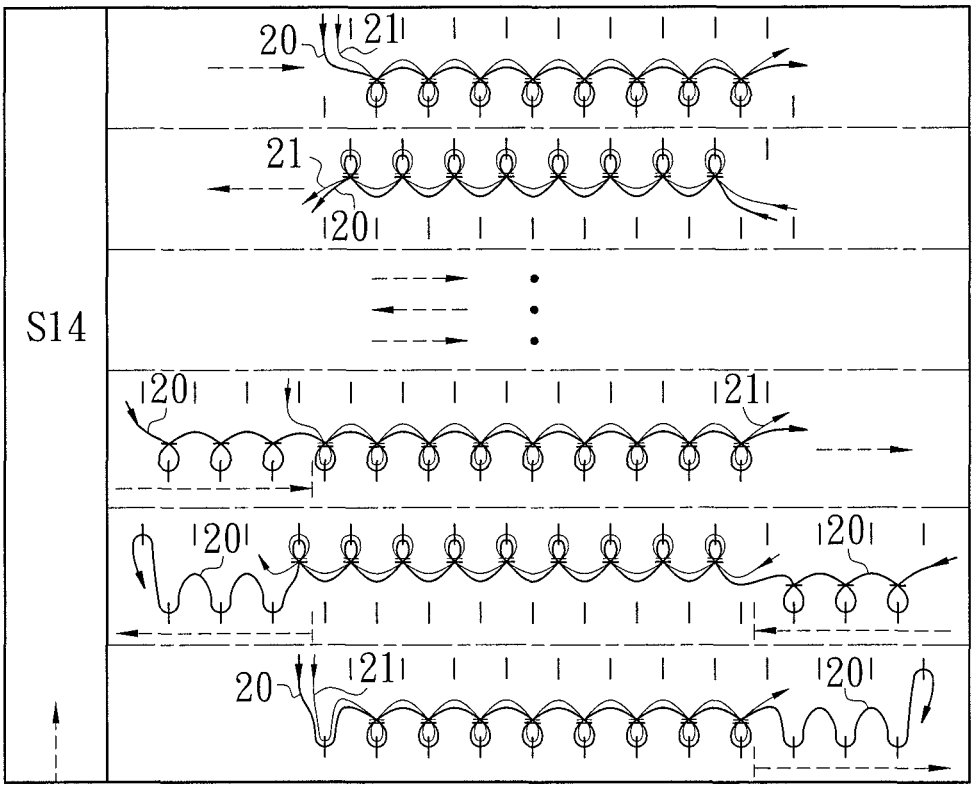
FIG. 19B is a second continuous schematic diagram of a weaving process according to the eighth embodiment of the present invention.
Figure 20:
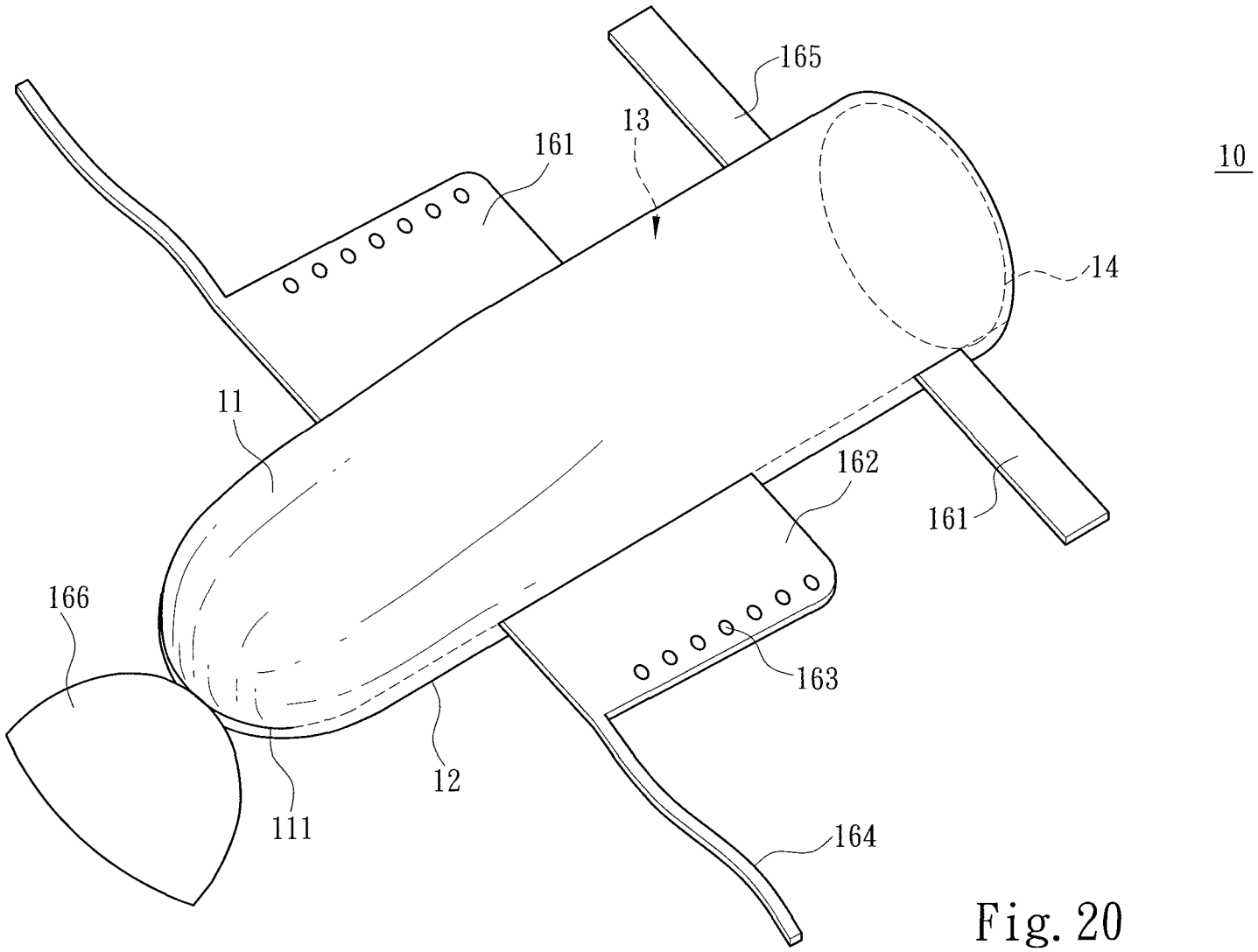
FIG. 20 is a perspective structural schematic diagram of a shoe embryo according to the eighth embodiment of the present invention.

In this step, when the front needle bed FB reaches the shoe upper stitch count while weaving the first shoe upper 11, the flat knitting machine 90, instead of weaving the second shoe upper 12 in a reverse direction, causes the front needle bed FB to continue weaving the other extension 162 opposite the extension 160 by knitting at least one of the yarns 20 and 21 according to the extension stitch count. Next, when the flat knitting machine 90 reaches the shoe upper stitch count while weaving the extension 162, the flat knitting machine 90 causes the yarn feeding mechanism 901 to perform yarn feeding in a reverse direction, and continues weaving the extension 162 according to the extension stitch count. When the front needle bed FB again reaches the extension stitch count, the flat knitting machine 90 weaves the second shoe upper 12. When the back needle bed BB reaches the shoe upper stitch count while weaving the second shoe upper 12, the flat knitting machine 90 causes the front needle bed FB at knit at least one of the yarns 20 and 21 to continue weaving from a part of the extension 160 that is previously woven, hence completing the first shoe upper 11, the second shoe upper 12 and the two extensions 160 and 162 by cyclically performing the above process. Thus, the two woven extensions 160 and 162 appear as two wings connected to the shoe embryo 10, as shown in FIG. 12. Each of the extensions 160 and 162 may be processed to stack on a surface of the first shoe upper 11 or the second shoe upper 12. The term "processed" may be an adhering or sewing process, as shown in FIG. 13.

Referring to FIG. 12, the patterns of the two extensions 160 and 162 are mutually corresponding. That is to say, when the knitted shoe prototype 100 is manufactured from the shoe embryo 10, in a top view of the knitted shoe prototype 100, the two extensions 160 and 162 are symmetrically disposed on the knitted shoe prototype 100, and may serve as shoe lace pieces of the shoe embryo 10. Further, colors of the two extensions 160 and 162 may be the same or different based on design requirements. Further, during the process of weaving each of the extensions 160 and 162 by the front needle bed FB or the back needle bed BB of the present invention, a plurality of loops 163 are formed through miss stitches. The size of the loops 163 needs to at least allow a strap intended for a shoe lace to pass through.

Again referring to FIG. 11 and FIG. 12, in one embodiment, step S12 further includes following steps. When each of the extensions 160 and 162 is woven, a strap 164 that partially extends from the extension 160 (or 162) is woven by knitting at least one of the yarns 20 and 21 according to an additional stitch count. The strap 164 may serve as a shoe lace of the shoe embryo 10. Further, during the weaving process in step S12, when the flat knitting machine 90 reaches the extension stitch count while weaving the extension 160 (or 162), the flat knitting machine 90 does not cause the yarn feeding mechanism 901 to progress in a reverse direction, and continues weaving the strap 164 according to the additional stitch count. When the front needle bed FB or the back needle bed BB again reaches the additional stitch count, weaving is performed in a reverse direction to continue weaving the strap 164, the extension 160 (or 162) and the second shoe upper 12. Further, the strap 164 is in fact merely a partial extension from the extension 160 (or 162), and the additional stitch count is adjusted according to the intended length of the strap 164. Further, FIG. 13 shows the knitted shoe prototype 100 manufactured from the shoe embryo 10 according to this embodiment.

Referring to FIG. 14 to FIG. 17, in one embodiment, the shoe embryo 10 includes the shoe lace piece and the ankle strap implemented in pairs when completely woven. Thus, after step S13, the method of the present invention further includes step S14. In step S14, when the shoe upper stitch count is reached by knitting at least one of the yarns 20 and 21 in the previous step, another extension 165 is woven at a position corresponding to the shoe opening 14, and unbroken-yarn weaving is performed in a reverse direction when the weaving process of the extension 165 reaches the extension stitch count. When the extension stitch count is again reached, the first shoe upper 11 and the second shoe upper 12 are woven by knitting the at least two yarns 20 and 21 according to the shoe upper stitch count, and weaving of the extension 161 is continued after the first shoe upper 11 and the second shoe upper 12 are woven. Thus, the above process is performed to weave the two extensions 161 and 165, the first shoe upper 11 and the second shoe upper 12.

More specifically, when the flat knitting machine 90 weaves the part of the shoe embryo 10 that corresponds to the shoe opening 14, and the front needle bed FB reaches the shoe upper stitch count while weaving the first shoe upper 11, the yarn feeding mechanism 901, instead of performing yarn feeding in a reverse direction to weave the second shoe upper 12, continues the current yarn feeding direction to have the front needle bed FB continue weaving the extension 165 according to the extension stitch count. When the front needle bed FB reaches the extension stitch count, the flat knitting machine 90 causes the yarn feeding mechanism 901 to perform yarn feeding in a reverse direction to allow the front needle bed FB to continue shaping the extension 165. Next, when the front needle bed FB again reaches the extension stitch count, the flat knitting machine 90 causes the back needle bed BB to perform weaving of the second shoe upper 12, and causes the front needle bed FB to continue weaving the extension 161 without yarn feeding in a reverse direction when the back needle bed BB reaches the shoe upper stitch count while weaving the second shoe upper 12. When the weaving process of the extension 161 reaches the extension stitch count, the flat knitting machine 90 again causes the front needle bed FB and the back needle bed BB to weave the first shoe upper 11, hence continually weaving the two extensions 161 and 165, the first shoe upper 11 and the second shoe upper 12. Accordingly, the woven shoe embryo 10 includes the extensions 160, 161, 162 and 165, namely, the shoe lace piece and the ankle strap.

Figure 21:
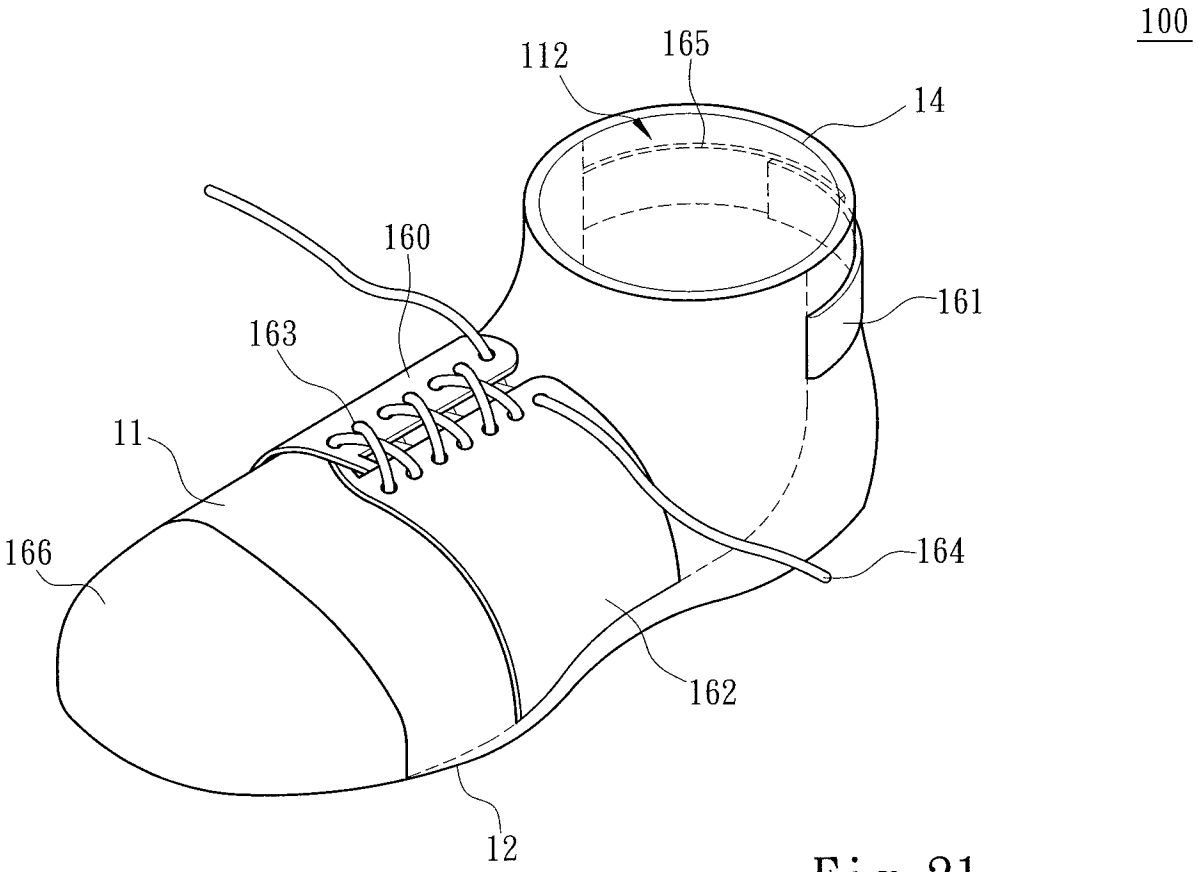
FIG. 21 is a perspective structural schematic diagram of a knitted shoe prototype according to the eighth embodiment of the present invention.
Figure 22:
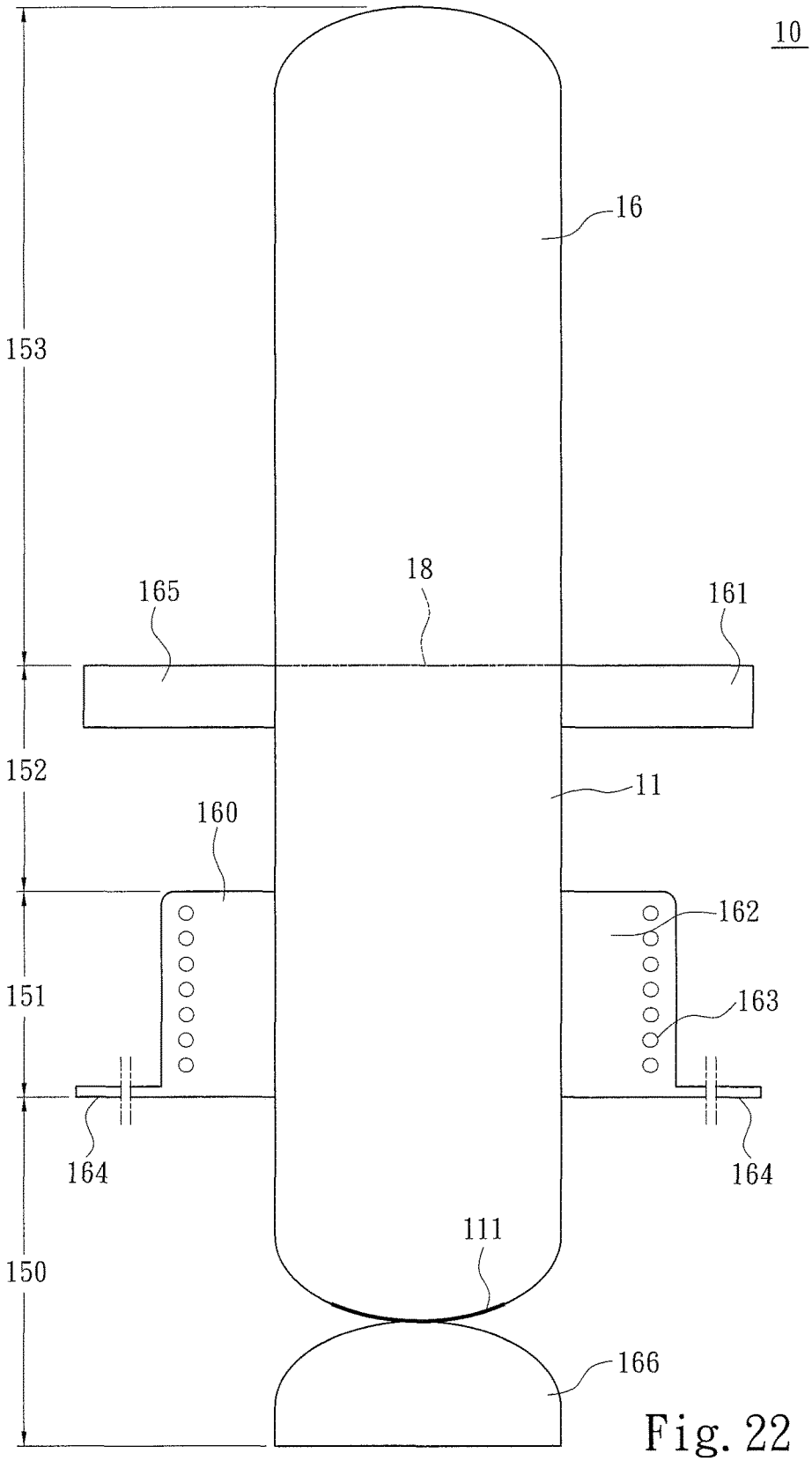
FIG. 22 is a planar schematic diagram of a shoe embryo according to a ninth embodiment of the present invention.
Figure 23A:
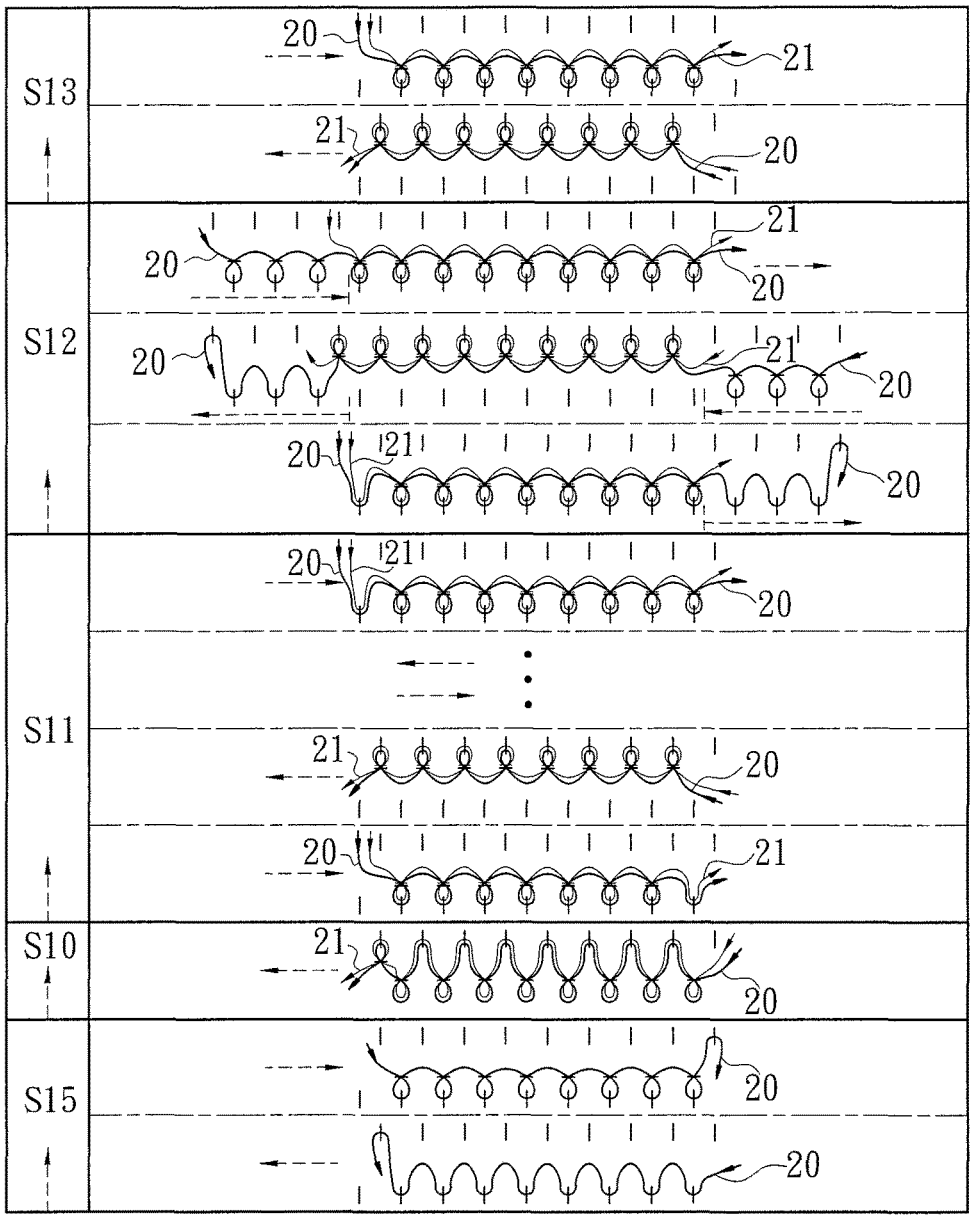
FIG. 23A is a first continuous schematic diagram of a weaving process according to the ninth embodiment of the present invention.
Figure 23B:
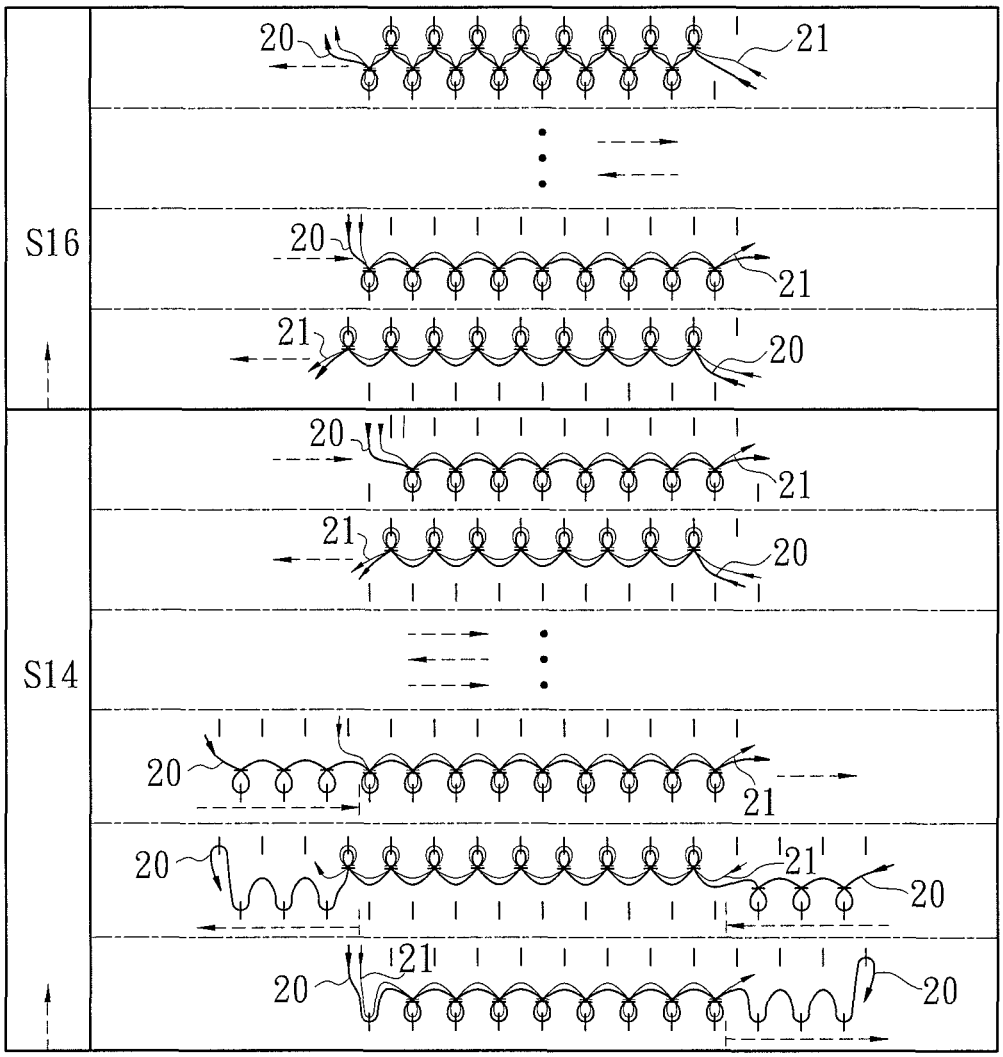
FIG. 23B is a second continuous schematic diagram of a weaving process according to the ninth embodiment of the present invention.

Referring to FIG. 18 to FIG. 21, in one embodiment, before step S10, the method of the present invention further includes step S15. In step S15, another extension 166 is woven at a front end of the shoe embryo 10 by knitting at least one of the yarns 20 and 21, and step S10 is performed in a unbroken-yarn manner after completing the above weaving. The extension 166 connected to the initial shoe edge 111 is a toe decoration piece of the shoe embryo 10. Further, in this embodiment, at the beginning of the weaving process of the shoe embryo 10, the front needle bed FB and the back needle bed BB are set to knit at least one of the yarns 20 and 21 to form the extension 166. A stitch count of the extension 166 is determined with reference to the shoe upper stitch count of the first shoe upper 11 or the second shoe upper 12, such that the size of the woven extension 166 at least corresponds to the size of the first shoe upper 11. Further, after the shoe embryo 10 is woven, the extension 166 may be processed and stacked on the first shoe upper 11, as shown in FIG. 21, with the term "processed" being an adhering or sewing process. Further, the extension 166 serving as the toe decoration piece may be woven from a plurality of the yarns 20 and 21, which may be in different colors and are not limited to the same color. Further, during the process of weaving the extension 166, the flat knitting machine 90 may suspend yarn feeding of the two yarns 20 and 21 and feed another new yarn, so as to produce overall color variations for the shoe embryo 10 through the fed new yarn. Further, in the present invention, the color of the yarn revealed at the first shoe upper 11 or the second shoe upper 12 has a different color from the yarn of the extension 166 located at the same side.

Referring to FIG. 22 to FIG. 25, in one embodiment, the shoe embryo 10 of the present invention may further include a lining section 153 that extends from the heel section 152. In the present invention, after step S13 or S14, the method further includes step S16. In step S16, a first lining 16 connected to the first shoe upper 11 is woven by knitting the at least two yarns 20 and 21, unbroken-yarn weaving is performed in a reverse direction when the shoe upper stitch count is reached to weave a second lining 17 that faces the first lining 16 and is connected to the second shoe upper 12 by knitting the two yarns 20 and 21, and the first lining 16 is woven in a reverse direction according to the shoe upper stitch count. Thus, the above process is cyclically performed to weave the first lining 16 and the second lining 17 are woven.

Further, in this embodiment, after the first shoe upper 11 or the second shoe upper 12 is woven, unbroken-yarn weaving is performed from the end of step S13 or S14 (e.g., a border between the first shoe upper 11 and the second shoe upper 12) to cause the back needle bed BB to knit the two yarns 20 and 21 to form the second lining 17 connected to the second shoe upper 12. When the back needle bed BB reaches the shoe upper stitch count while weaving the second lining 17, the flat knitting machine 90 continues weaving in an unbroken-yarn manner, and causes the yarn feeding mechanism 901 to perform yarn feeding in a reverse direction and the front needle bed FB to weave the first lining 16 connected to the first shoe upper 11. Thus, the above process is cyclically performed to weave the first lining 16 and the second lining 17 and complete weaving. Further, in practice, the method for weaving the first lining 16 and the second lining 17 may be identical to that for weaving the first shoe upper 11 and the second shoe upper 12, and the sequence of weaving the first lining 16 and the second lining 17 is not limited and may be adjusted according to application requirements. Further, lengths of the first lining 16 and the second lining 17 are similar to those of the first shoe upper 11 and the second shoe upper 12.

Figure 24:
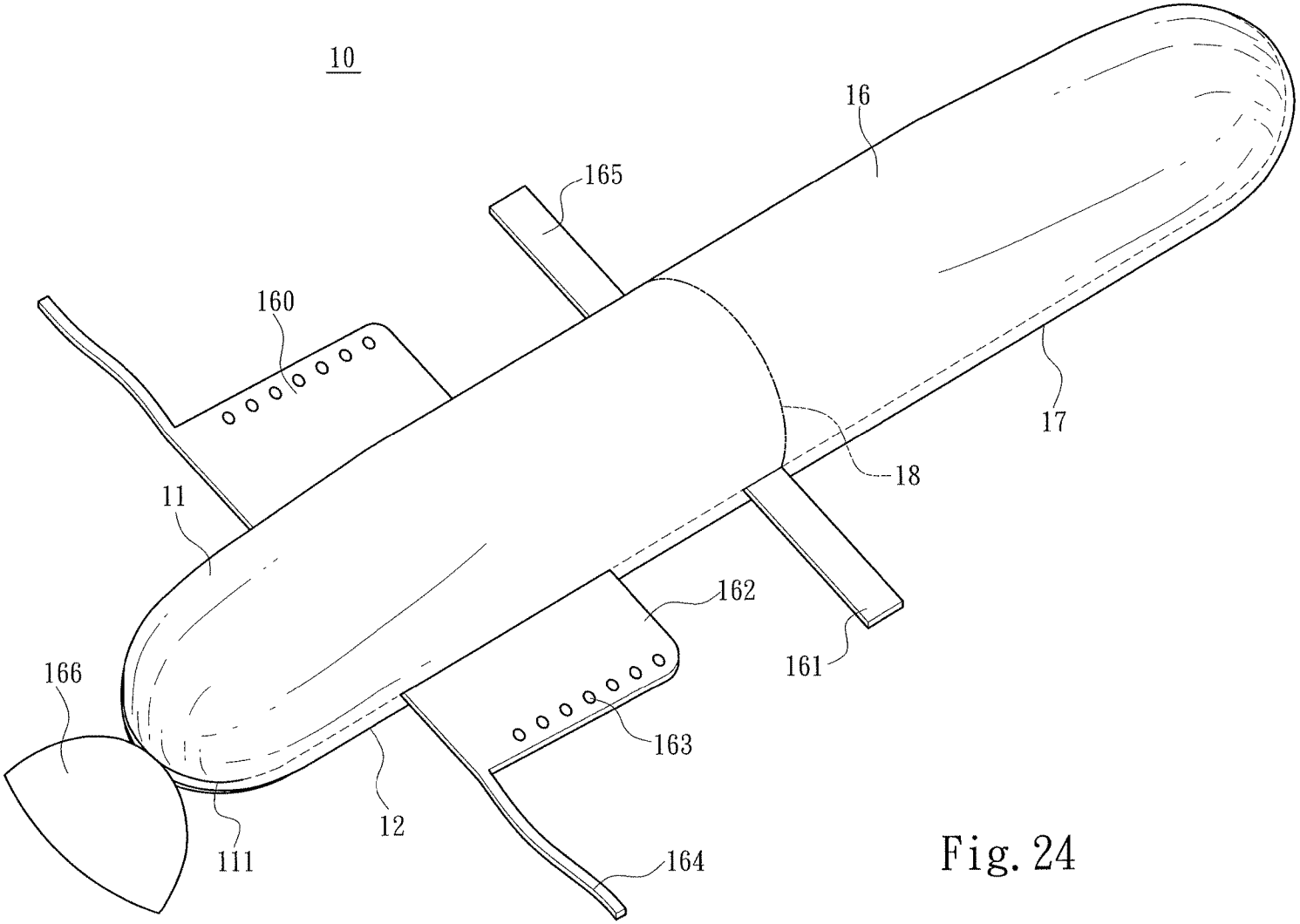
FIG. 24 is a perspective structural schematic diagram of a shoe embryo according to the ninth embodiment of the present invention.
Figure 25:
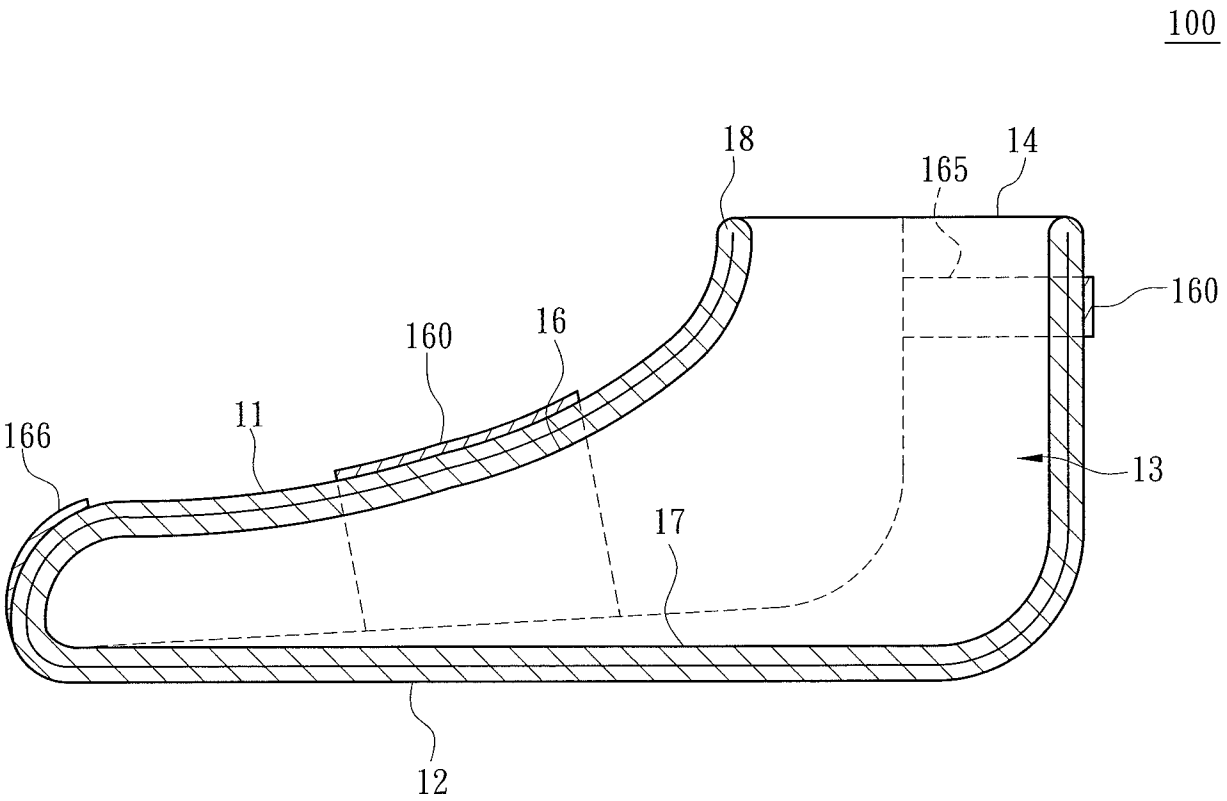
FIG. 25 is a sectional structural schematic diagram of a knitted shoe prototype according to the ninth embodiment of the present invention.

Referring to FIG. 24 and FIG. 25, during the process of manufacturing the knitted shoe prototype 100 from the shoe embryo 10, from a joining border (e.g. the denotation 18) of the first shoe upper 11 and the first lining 16, the first lining 16 and the second lining 17 are simultaneously fitted into the in-shoe space 13, and edges of the first lining 16 and the second lining 17 are sewn or adhered to an inner side of the first shoe upper 11 or the second shoe upper 12. FIG. 21 shows a section view of the completed knitted shoe prototype 100. Further, during the implementation process of step S16, through a yarn-changing for a color-changing process, the flat knitting machine 90 may cause the colors of the yarns that the first lining 16 and the second lining 17 present in the in-shoe space 13 to be different from the colors of the yarns at outer surfaces of the first shoe upper 11 and the second shoe upper 12.

Figure 26:
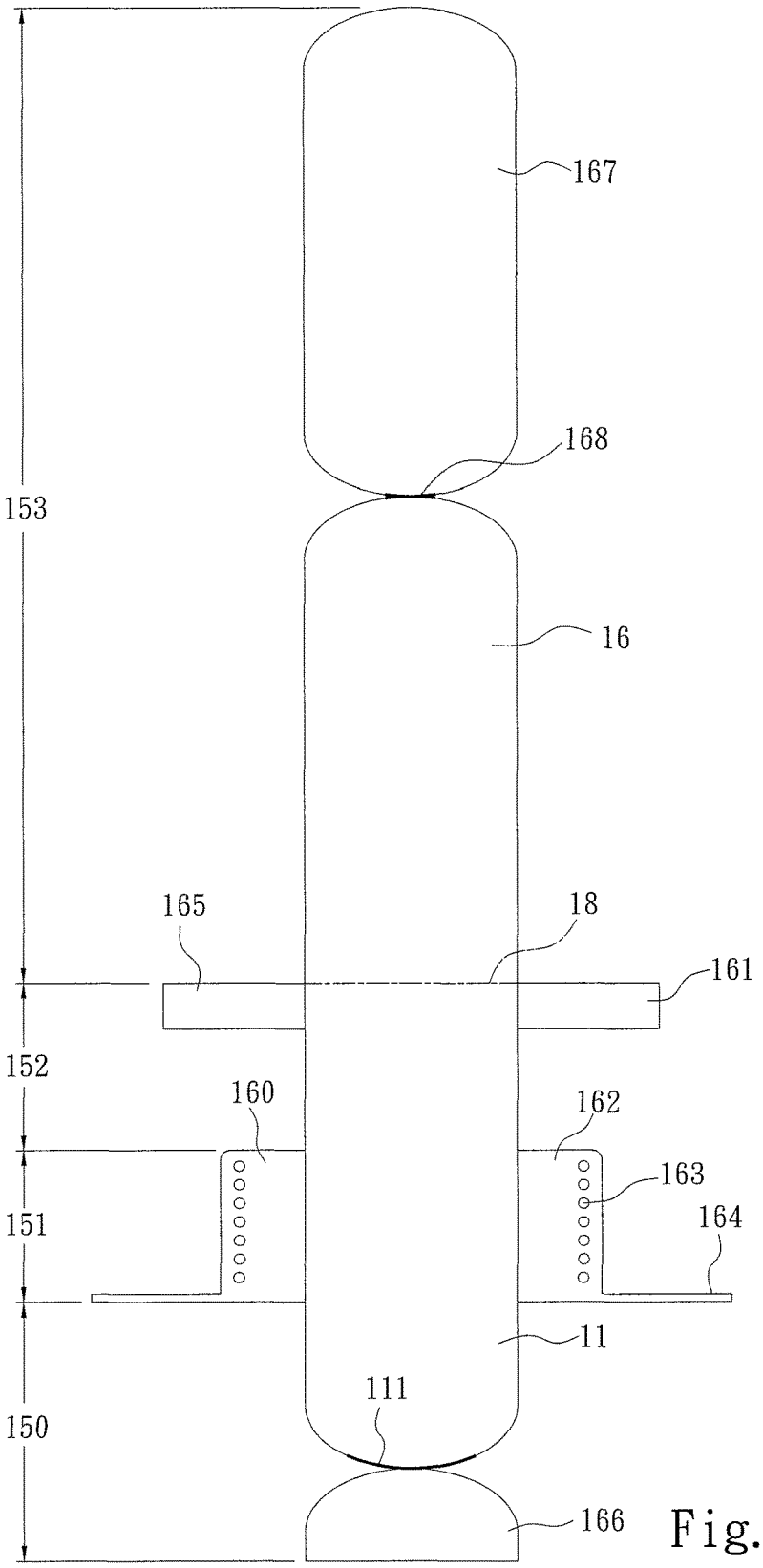
FIG. 26 is a planar schematic diagram of a shoe embryo according to a tenth embodiment of the present invention.
Figure 27A:
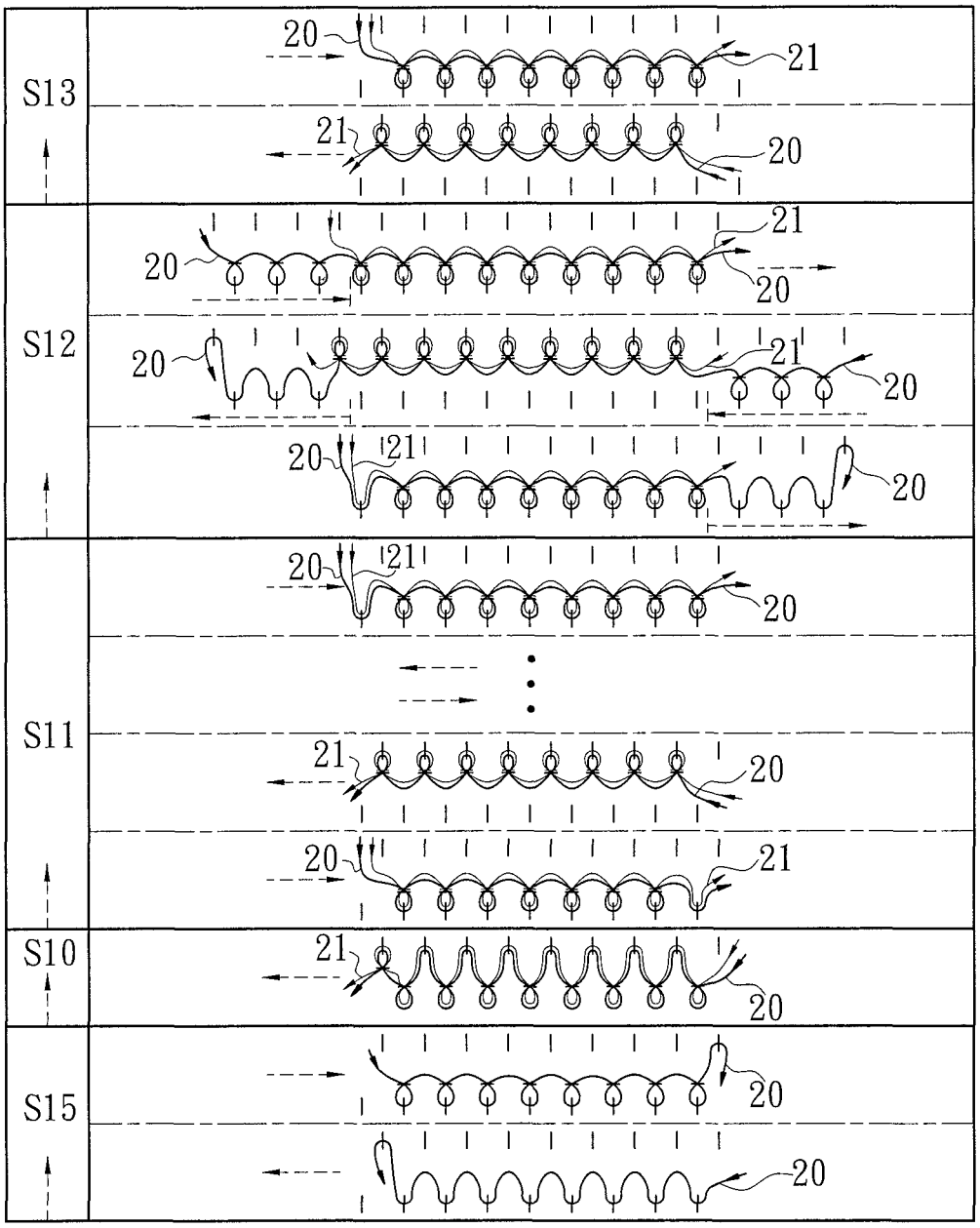
FIG. 27A is a first continuous schematic diagram of a weaving process according to the tenth embodiment of the present invention.
Figure 27B:
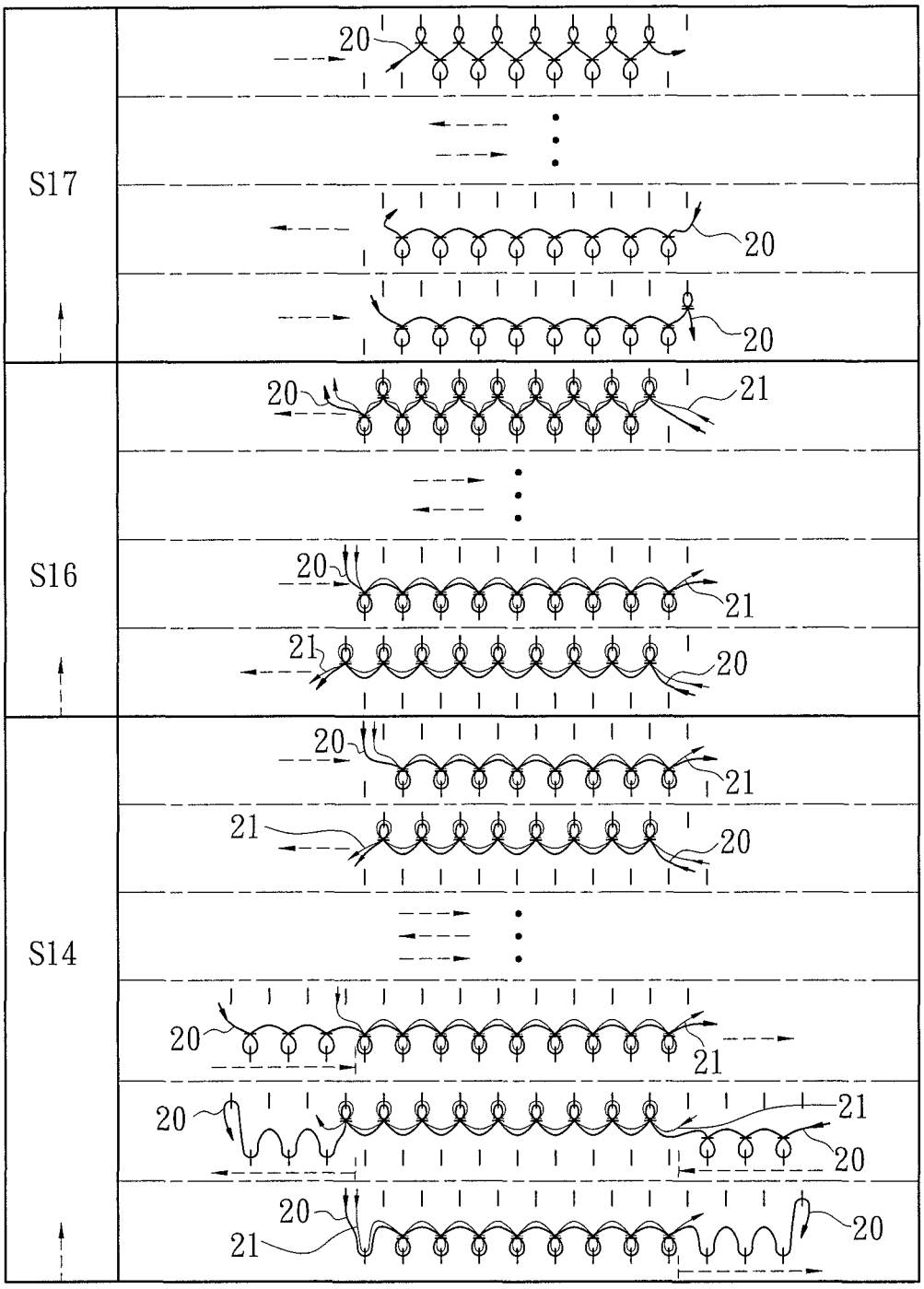
FIG. 27B is a second continuous schematic diagram of a weaving process according to the tenth embodiment of the present invention.
Figure 28:
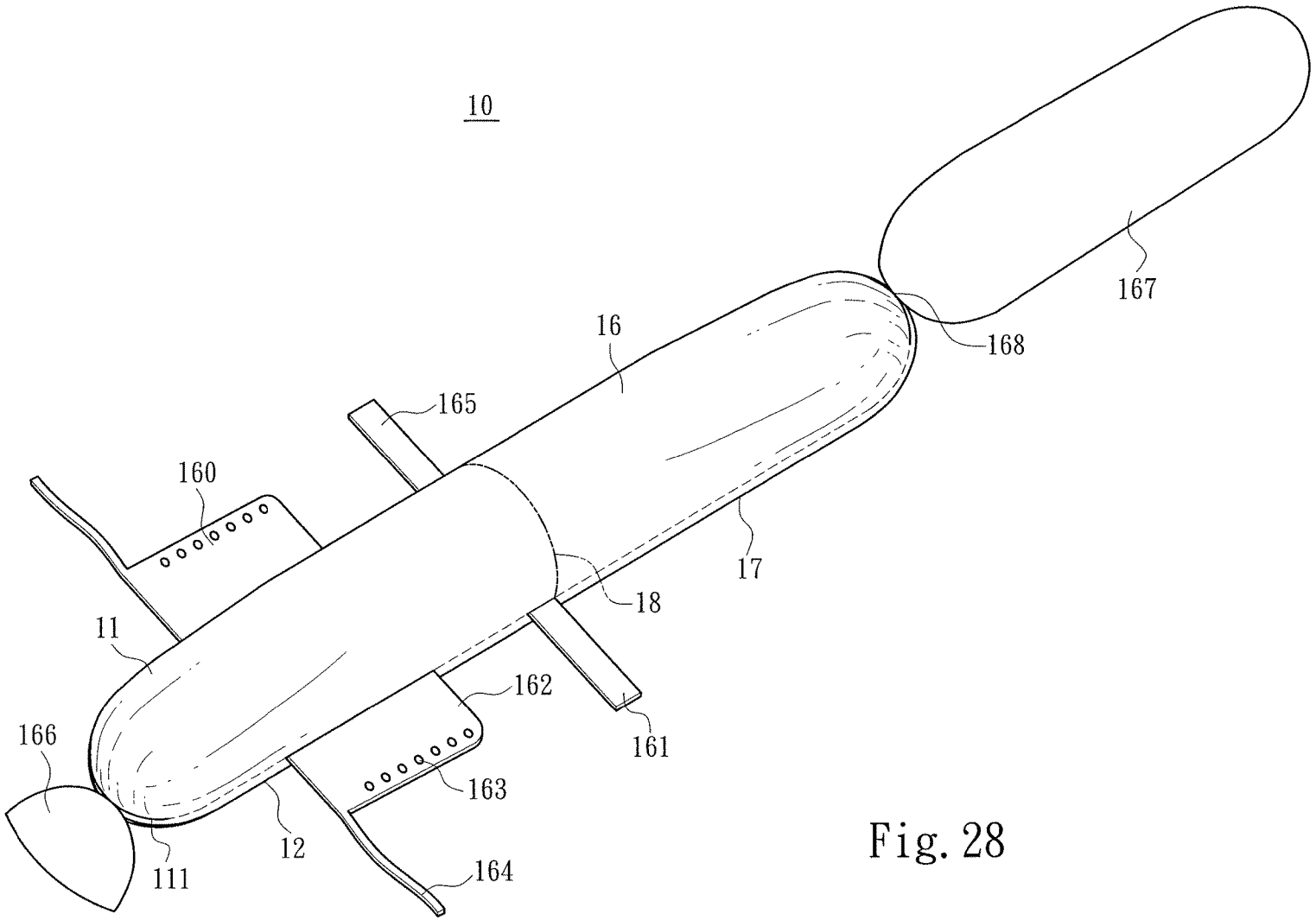
FIG. 28 is a perspective structural schematic diagram of a shoe embryo according to the tenth embodiment of the present invention.
Figure 29:
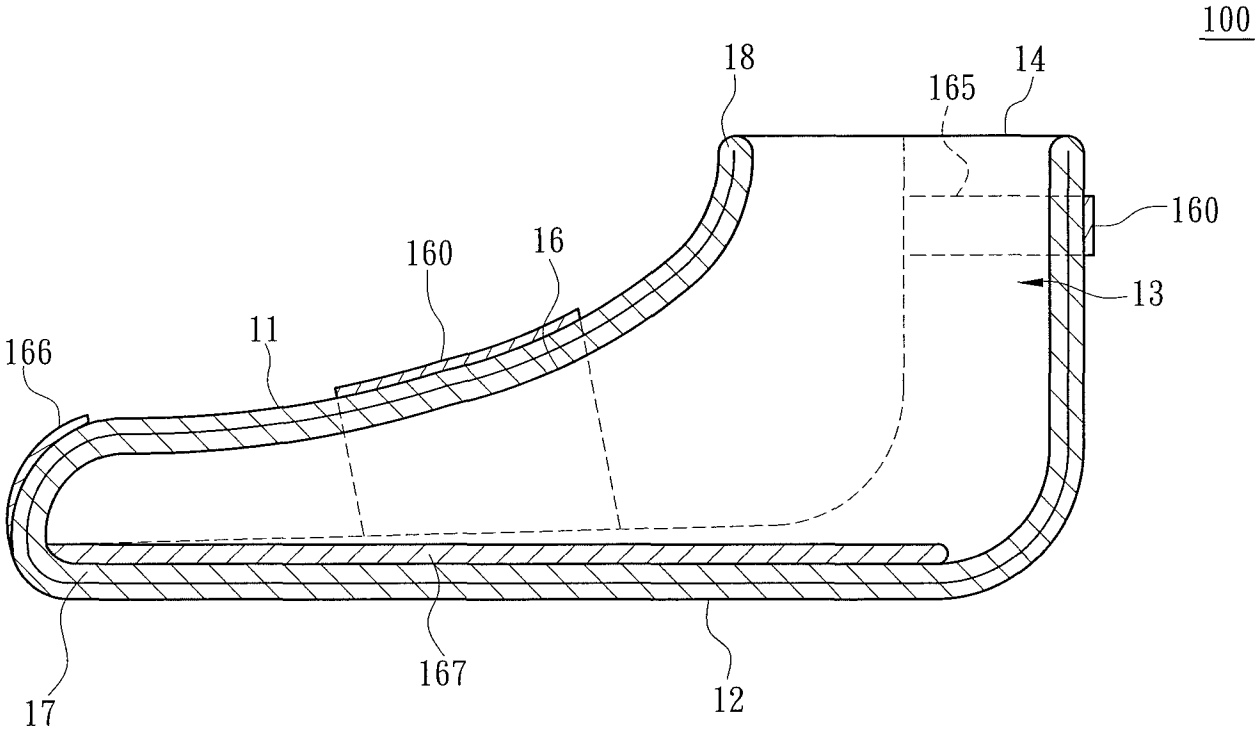
FIG. 29 is a sectional structural schematic diagram of a knitted shoe prototype according to the tenth embodiment of the present invention.

In continuation of the foregoing embodiment, referring to FIG. 26 and FIG. 29, the present invention may further provide another extension 167 at one end of the first lining 16 and the second lining 17. The extension 167 may serve as a sole piece when the shoe is manufactured. Further, after step S16, the method of the present invention further includes step S17. In step S17, a lining end edge 168 is interwoven by knitting the two yarns 20 and 21, and unbroken-yarn weaving is performed to weave the extension 167 away from the direction of the lining end edge 168 by knitting at least one of the yarns 20 and 21. The extension 167 is a sole piece. More specifically, in this step, after completing weaving the first lining 16 and the second lining 17 by the front needle bed FB and the back needle bed BB, the flat knitting machine 90 continues unbroken-yarn weaving to weave the lining end edge 168 from the end of the first lining 16 and the second lining 17. The flat knitting machine 90 continues unbroken-yarn weaving, and causes the front needle bed FB and the back needle bed BB to weave the extension 167 connected to the lining end edge 168. A weaving length of the extension 167 may be adjusted according to the length of the first shoe upper 11 or the second shoe upper 12. Further, the method for weaving the extension 167 may be different from that for weaving the first lining 16 and the second lining 17, and may be implemented by a method that forms a more sturdy structure. Further, during the weaving process of step S17, the number of the extension 167 woven may be increased, and a plurality of extensions 167 are sequentially stacked to increase the thickness of the sole piece. Referring to FIG. 28 and FIG. 29, during the process of manufacturing the knitted shoe prototype 100 from the shoe embryo 10, the extension 167 is together place in the in-shoe space 13 while the first lining 16 and the second lining 17 are placed into the in-shoe space 13, and then stacked on the second lining 17. Further, the extension 167 may be secured through adhesion or sewing. On the other hand, the extension 167 serving as the sole piece may be woven from a plurality of the yarns 20 and 21, which may further be in different colors.

Figure 30:
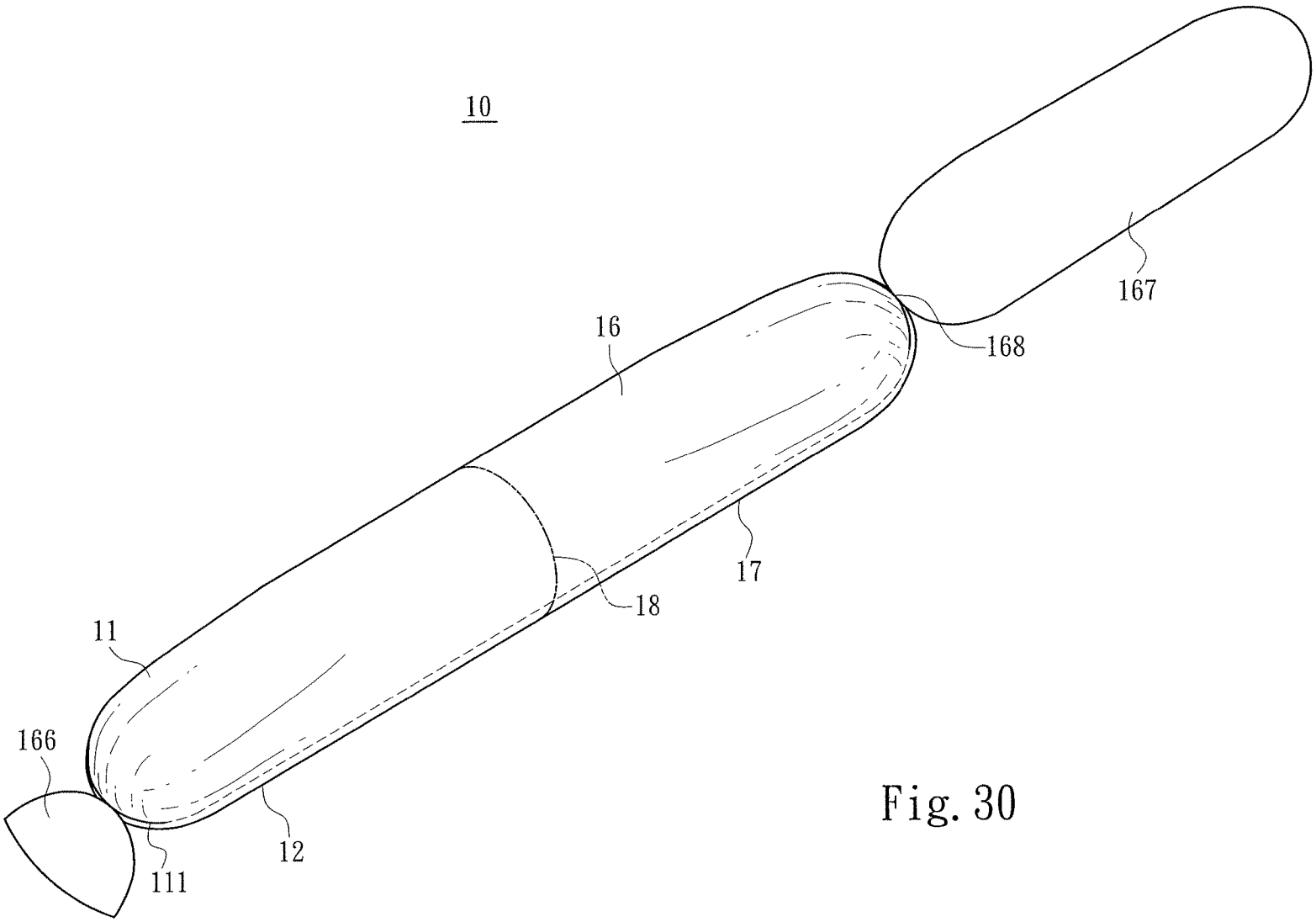
FIG. 30 is a perspective structural schematic diagram of a shoe embryo according to an eleventh embodiment of the present invention.
Figure 31:
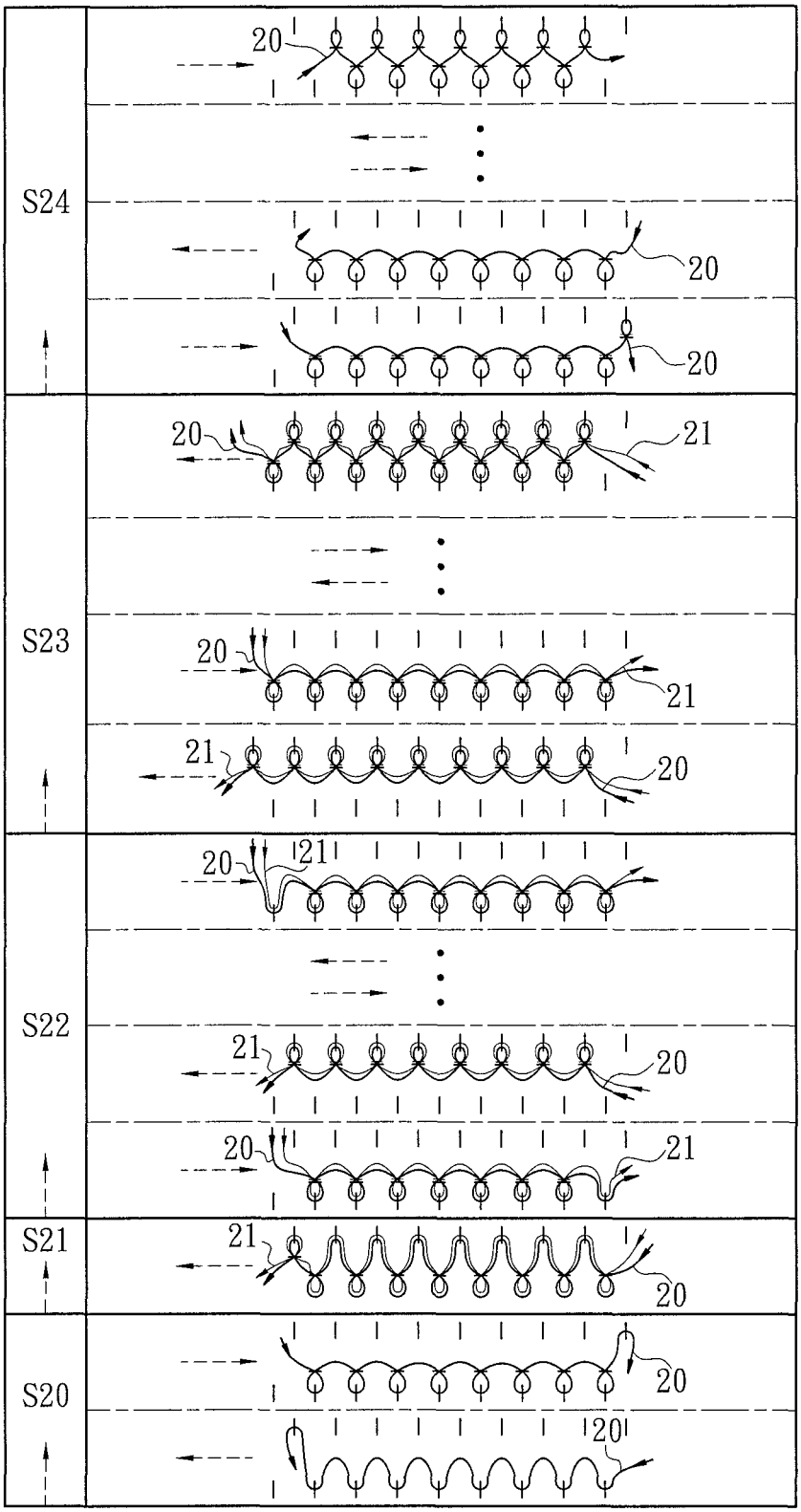
FIG. 31 is a schematic diagram of a weaving process according to the eleventh embodiment of the present invention.

Referring to FIGS. 30 and 31, in one embodiment, the method includes step S20 to step S22 below.

In step S20, the extension 166 is woven by knitting at least one of the yarns 20 and 21, and weaving is later carried on in an unbroken-yarn manner. The extension 166 serves as a toe decoration of the shoe embryo 10.

In step S21, the initial shoe edge 111 connected to the extension 166 is interwoven by knitting the two yarns 20 and 21.

In step S22, the first shoe upper 11 connected to the initial shoe edge 111 is woven by knitting the at least two yarns 20 and 21, unbroken-yarn weaving is performed in a reverse direction when the shoe upper stitch count is reached to weave the second shoe upper 12 facing the first shoe upper 11, and the first shoe upper 11 is woven in a reverse direction according to the shoe upper stitch count. Thus, the above process is cyclically performed to weave the first shoe upper 11 and the second shoe upper 12, and the shoe opening 14 is formed to complete the shoe embryo 10.

More specifically, at the beginning of the weaving process of the shoe embryo 10, the front needle bed FB and the back needle bed BB of the flat knitting machine 90 are set to first form the extension 166 by knitting at least one of the yarns 20 and 21, and the stitch count of the extension 166 is determined with reference to the shoe upper stitch count of the first shoe upper 11 or the second shoe upper 12. After the extension 166 is woven by the flat knitting machine 90, the flat knitting machine 90 continues unbroken-yarn weaving to sequentially weave the first shoe upper 11 and the second shoe upper 12 by knitting the two yarns 20 and 21 using the front needle bed FB and the back needle bed FB to complete the shoe embryo 10. FIG. 30 shows a woven shoe embryo 10. Further, in one embodiment, the extension 166 may be woven from a plurality of the yarns 20 and 21, and the weaving process may be implemented by thread weaving or yarn-changing and color-changing weaving. When the flat knitting machine 90 weaves the extension 166 by yarn-changing and color-changing weaving, the colors of the yarns revealed at the first shoe upper 11 and the second shoe upper 12 are different from the color of the yarn of the extension 166 located at the same side.

Referring to FIG. 30 and FIG. 31, in a weaving process of the shoe embryo 10 of the embodiment, the first lining 16, the second lining 17 and the extension 167 that serves as the sole piece may be together formed. Thus, after step S22, the method of the present invention further includes step S23. In step S23, the first lining 16 connected to the first shoe upper 11 is woven by knitting the at least two yarns 20 and 21, unbroken-yarn weaving is performed in a reverse direction when the shoe upper stitch count is reached to weave the second lining 17 that faces the first lining and is connected to the second shoe upper 12 by knitting the two yarns 20 and 21, and the first lining 16 is woven in a reverse direction according to the shoe upper stitch count. Thus, the above process is cyclically performed to weave the first lining 16 and the second lining 17. Implementation details of step S23 are identical to those of step S16, and shall be omitted herein. In addition, after step S23, the method according to the embodiment of the present invention further includes step S24. In step S24, the lining end edge 168 is interwoven by knitting the two yarns 20 and 21, and unbroken-yarn weaving is performed to weave the extension 167 that extends away from the direction of the lining end edge 168 by knitting at least one of the yarns 20 and 21. The extension 167 is a sole piece. Implementation details of step S23 are identical to those of step S17, and shall be omitted herein.

Known from the weaving details disclosed by the schematic diagrams of the weaving processes of the present invention, the first shoe upper 11 and the second shoe upper 12 of the present invention may respectively be woven by different yarns (20 and 21). That is to say, if the needle beds (i.e., the front needle bed FB and the back needle bed BB) perform weaving by different yarns, when the needle bed (e.g., the front needle bed FB) currently performing weaving reaches an end, yarn stitching and securing is assisted by a needle of the other needle bed (e.g., the back needle bed BB) at the opposite side, thereby interweaving the first shoe upper 11 and the second shoe upper 12 to form a sac shape.

What is claimed is:

1. A method for integrally knitting a shoe blank having an extension by a flat knitting machine, comprising steps of:

S10: interlacing an initial shoe edge by knitting at least two yarns;

S11: forward knitting the at least two yarns which are connected to the initial shoe edge to be a first shoe upper, then backward knitting the at least two yarns to be a second shoe upper facing the first shoe upper when a number of a plurality of shoe upper stitches is reached to a predetermined count, further forward knitting the at least two yarns according to the number of the plurality of shoe upper stitches again to be the first shoe upper, and cyclically performing the above process to form the first shoe upper and the second shoe upper;

S12: continuing forward knitting at least one of the yarns to be an extension when the number of the plurality of shoe upper stitches is reached the predetermined count in the previous step, then backward knitting the at least one of the yarns when a number of a plurality of extension stitches of the extension is knitted to reach a predetermined count, further continuing forward and backward knitting the at least two yarns according to the number of the plurality of shoe upper stitches to be the first shoe upper and the second shoe upper when the number of the plurality of extension stitches is reached to the predetermined count again, and cyclically performing the above process to knit the extension, the first shoe upper and the second shoe upper; and S13: cyclically forward and backward knitting the at least two yarns to be the first shoe upper and the second shoe upper, and forming a shoe opening to complete the shoe blank.

2. The method for integrally knitting a shoe blank having an extension by a flat knitting machine of claim 1, wherein the extension is one of a vamp decoration piece and an ankle strap of the shoe blank, the extension is connected to a vamp section of the shoe blank when being the vamp decoration piece, and the extension is connected to a heel section having the shoe opening of the shoe blank when being the ankle strap.

3. The method for integrally knitting a shoe blank having an extension by a flat knitting machine of claim 1, wherein in step S12, after the extension is knitted, when the at least two yarns is knitted to be the first shoe upper or the second shoe upper at which the number of the plurality of shoe upper stitches is reached, forward knitting at least one of the yarns to be another extension facing the extension, and when a number of the plurality of extension stitched is reached, backward knitting the at least two yarns according to the number of the plurality of extension stitches to form the first shoe upper or the second shoe upper, and then knitting of the extension is continued when the number of the plurality of shoe upper stitches is reached, and the above process is cyclically performed to form the first shoe upper, the second shoe upper and the two extensions.

4. The method for integrally knitting a shoe blank having an extension by a flat knitting machine of claim 3, wherein the two extensions have corresponding patterns, and serve as shoe lace pieces of the shoe blank.

5. The method for integrally knitting a shoe blank having an extension by a flat knitting machine of claim 4, wherein each of the extensions comprises a plurality of loops when woven.

6. The method for integrally knitting a shoe blank having an extension by a flat knitting machine of claim 5, wherein in step S12, when knitting each of the extensions, a strap that partially extends from the extension is formed by knitting at least one of the yarns according to a number of the plurality of additional stitches, and the strap is a shoe lace of the shoe blank.

7. The method for integrally knitting a shoe blank having an extension by a flat knitting machine of claim 1, wherein the two yarns are in different colors.

8. The method for integrally knitting a shoe blank having an extension by a flat knitting machine of claim 7, wherein a color of the yarn revealed the first shoe upper or the second shoe upper is different from a color of the yarn of the extension located at a same side.

9. The method for integrally knitting a shoe blank having an extension by a flat knitting machine of claim 1, wherein one of the two yarns is clad with a hot melt layer.

10. The method for integrally knitting a shoe blank having an extension by a flat knitting machine of claim 1, before step S10, further comprising a step of:

S15: knitting at least one of the yarns to form another extension located at a front end of the shoe blank, and performing step S10 after the another extension is formed, the another extension connected to the initial shoe edge being a toe decoration piece of the shoe blank.

11. The method for integrally knitting a shoe blank having an extension by a flat knitting machine of claim 10, wherein the two yarns are in different colors.

12. The method for integrally knitting a shoe blank having an extension by a flat knitting machine of claim 11, wherein a color of the yarn revealed at the first shoe upper or the second shoe upper is different from a color of the yarn of the extensions located at a same side.

13. The method for integrally knitting a shoe blank having an extension by a flat knitting machine of claim 10, wherein one of the two yarns is clad with a hot melt layer.

14. The method for integrally knitting a shoe blank having an extension by a flat knitting machine of claim 10, after step S13, the method further comprising a step of:

S16: backward knitting the at least two yarns to form a first lining connected to the first shoe upper, forward knitting the two yarns to form a second lining that faces the first lining and is connected to the second shoe upper when the number of the plurality of shoe upper stitches is reached, and backward knitting the first lining according to the number of the plurality of shoe upper stitches, and cyclically performing the above process to form the first lining and the second lining.

15. The method for integrally knitting a shoe blank having an extension by a flat knitting machine of claim 14, wherein the two yarns are in different colors.

16. The method for integrally knitting a shoe blank having an extension by a flat knitting machine of claim 15, wherein a color of the yarn revealed at the first shoe upper or the second shoe upper is different from a color of the yarn of the first lining and the second lining located at a same side.

17. The method for integrally knitting a shoe blank having an extension by a flat knitting machine of claim 14, wherein one of the two yarns is clad with a hot melt layer.

18. The method for integrally knitting a shoe blank having an extension by a flat knitting machine of claim 14, after step S16, further comprising a step of:

S17: interlacing a lining end edge by knitting the two yarns, and knitting at least one of the yarns to be another extension towards a direction away from the lining end edge, the extension being a sole piece.

19. The method for integrally knitting a shoe blank having an extension by a flat knitting machine of claim 1, after step S13, further comprising a step of:

S16: backward knitting the at least two yarns to form a first lining connected to the first shoe upper, forward knitting the two yarns to form a second lining that faces the first lining and is connected to the second shoe upper when the number of the plurality of shoe upper stitches is reached , and backward knitting the first lining according to the number of the plurality of shoe upper stitches, and cyclically performing the above process to form the first lining and the second lining.

20. The method for integrally knitting a shoe blank having an extension by a flat knitting machine of claim 19, after step S16, further comprising a step of:

S17: interlacing a lining end edge by knitting the two yarns, and knitting at least one of the yarns to be another extension towards a direction away from the lining end edge, the extension being a sole piece.

21. A method for integrally knitting a shoe blank having an extension by a flat knitting machine, comprising steps of:

S20: forward knitting at least one of yarns to be an extension, the extension being a toe decoration piece of the shoe blank when completely knitted;

S21: interlacing an initial shoe edge connected to the extension by knitting the two yarns; and S22: forward knitting the at least two of the yarns connected to the initial shoe edge to be a first shoe upper, then backward knitting the two yarns to be a second shoe upper facing the first shoe upper when a number of a plurality of shoe upper stitches is reached to a predetermined count, further forward knitting the at least two of the yarns to be the first shoe upper according to the number of the plurality of shoe upper stitches, and cyclically performing the above process to form the first shoe upper and the second shoe upper, and forming a shoe opening to complete the shoe blank.

22. The method for integrally knitting a shoe blank having an extension by a flat knitting machine of claim 21, wherein the two yarns are in different colors.

23. The method for integrally knitting a shoe blank having an extension by a flat knitting machine of claim 22, wherein a color of the yarn revealed at the first shoe upper or the second shoe upper is different from a color of the yarn of the extension located at a same side.

24. The method for integrally knitting a shoe blank having an extension by a flat knitting machine of claim 21, wherein one of the two yarns is clad with a hot melt layer.

25. The method for integrally knitting a shoe blank having an extension by a flat knitting machine of claim 21, after step S22, further comprising a step of:

S23: backward knitting the at least two of the yarns to form a first lining connected to the first shoe upper, forward knitting the two yarns to form a second lining that faces the first lining and is connected to the second shoe upper when the number of the plurality of shoe upper stitches is reached, and backward knitting the first lining according to the number of the plurality of shoe upper stitches, and cyclically performing the above process to form the first lining and the second lining.

26. The method for integrally knitting a shoe blank having an extension by a flat knitting machine of claim 25, after step S23, further comprising:

S24: interlacing a lining end edge by knitting the two yarns, and knitting at least one of the yarns to be another extension towards a direction away from the lining end edge, the extension being a sole piece.

* * * * *